US012162637B2

(12) United States Patent
Verheij et al.

(10) Patent No.: US 12,162,637 B2
(45) Date of Patent: Dec. 10, 2024

(54) WRAPPING MODULE AND A METHOD FOR PROVIDING A SLEEVE AROUND A MAIL ITEM

(71) Applicant: Buhrs Packaging Solutions B.V., Zaandam (NL)

(72) Inventors: Benedictus Johannes Maria Verheij, Rotterdam (NL); Jan Gijsbert Kranstauber, Driemond (NL)

(73) Assignee: BUHRS PACKAGING SOLUTIONS B.V., Zaandam (NL)

( * ) Notice: Subject to any disclaimer, the term of this patent is extended or adjusted under 35 U.S.C. 154(b) by 100 days.

(21) Appl. No.: 17/961,202

(22) Filed: Oct. 6, 2022

(65) Prior Publication Data

US 2023/0116742 A1 Apr. 13, 2023

(30) Foreign Application Priority Data

Oct. 7, 2021 (NL) ..... 2029342

(51) Int. Cl.
*B65B 25/14* (2006.01)
*B65B 9/067* (2012.01)
(Continued)

(52) U.S. Cl.
CPC ..... *B65B 25/14* (2013.01); *B65B 9/067* (2013.01); *B65B 11/10* (2013.01); *B65B 27/08* (2013.01);
(Continued)

(58) Field of Classification Search
CPC ..... B65B 25/14; B65B 35/56; B65B 35/58; B65B 35/24; B65B 11/10; B65B 11/12;
(Continued)

(56) References Cited

U.S. PATENT DOCUMENTS 3,172,655 A 3/1965 Lenk
4,406,251 A * 9/1983 Neri ..... B65H 19/14 118/235
(Continued)

FOREIGN PATENT DOCUMENTS

DE 1 084 278 B 6/1960
EP 0 444 547 A1 9/1991
(Continued)

OTHER PUBLICATIONS

Dutch Search Report, issued in Priority Application No. 2029342, dated Jun. 13, 2022.

*Primary Examiner* — Joshua G Kotis

(74) *Attorney, Agent, or Firm* — Birch, Stewart, Kolasch & Birch, LLP

(57) ABSTRACT

A wrapping module and a method for providing a sleeve around a mail item are disclosed. A sheet is folded over a leading edge of each mail item so that a first part of the sheet is folded against an upper side of the mail item and the second part of the sheet is folded against a lower side of the mail item and a third part of the sheet extends in the upstream direction beyond the trailing edge of the mail item. Glue is dispensed on the third part. The mail item is turned around with a turning station having a pendulum so that the third part of the sheet is folded around the mail item so that the third part is connected to the first part by the glue to form the sleeve.

18 Claims, 22 Drawing Sheets

(51) Int. Cl.

| | |
|---|---|
| ***B65B 11/10*** | (2006.01) |
| ***B65B 27/08*** | (2006.01) |
| ***B65B 35/24*** | (2006.01) |
| ***B65B 35/58*** | (2006.01) |
| ***B65B 51/02*** | (2006.01) |

(52) U.S. Cl.
CPC ..... *B65B 35/24* (2013.01); *B65B 35/58* (2013.01); *B65B 51/023* (2013.01)

(58) Field of Classification Search
CPC ..... B65B 11/20; B65B 11/22; B65B 11/30; B65B 11/32; B65B 11/40; B65B 27/08; B65B 13/30; B65B 13/32; B65B 13/16; B65B 9/067; B65B 9/026; B65B 51/023; B65C 1/04; B65C 1/047
See application file for complete search history.

(56) References Cited

U.S. PATENT DOCUMENTS 4,412,411 A 11/1983 Hashimoto et al.
4,909,019 A * 3/1990 Delacretaz ..... B65B 51/14 53/466
5,203,953 A 4/1993 Focke et al.
6,035,612 A * 3/2000 Draghetti ..... B65B 19/226 53/201
6,047,529 A * 4/2000 Draghetti ..... B65B 51/02 53/466
6,640,522 B2 * 11/2003 Antoniazzi ..... B65B 35/58 53/223
6,766,625 B2 * 7/2004 Cinotti ..... B65B 11/12 53/376.5
6,865,862 B2 * 3/2005 Daoust ..... B65B 25/145 53/529
8,156,717 B2 * 4/2012 Jorgensen ..... B65B 25/14 53/228
9,073,653 B2 * 7/2015 Cavazza ..... B65B 11/32
10,597,180 B2 * 3/2020 Cassoli ..... B65B 59/001
2003/0104092 A1 * 6/2003 Suzuki ..... B31B 50/16 425/363
2018/0002049 A1 * 1/2018 Avanzi ..... B65B 11/20

FOREIGN PATENT DOCUMENTS

EP 526946 A1 * 2/1993 ..... B65H 3/0875
EP 1 621 461 A1 2/2006
EP 0 526 944 B2 8/2007
EP 2 636 604 A1 9/2013
FR 2.175.230 10/1973
NL 167380 C 12/1981
WO WO 97/35766 A1 10/1997

* cited by examiner

WRAPPING MODULE AND A METHOD FOR PROVIDING A SLEEVE AROUND A MAIL ITEM

FIELD

The invention relates to a wrapping module and a method for providing a sleeve around a mail item.

BACKGROUND

A method and a wrapping module for continuously wrapping mail items in paper is known from EP 0 526 944 B2. In this known method a mail item is placed on a continuous web of paper which is moved in a transport direction with a substantially constant transport speed. The longitudinal edges of the paper web are folded over lengthwise around the edges of the mail item which extend in the transport direction of the mail item. Glue dispensers apply glue on one of the longitudinal edges of the paper web and also transversally between the mail items which have been placed on the paper web. During transport the longitudinal edges of the web are placed on top of one another and connected by the glue dispensed on one of the longitudinal edges. Subsequently, the paper web, which is by then a continuous paper tube is cut in a transverse direction between the subsequent mail items. At the same time, the parts of the web on which the glue is applied transversally are pressed onto each other to provide a sort of a paper envelop which is closed around all the sides of the mail item.

EP 1 621 461 A1 also discloses a wrapping module in which packaging material is folded in a transport direction around mail items to form a continuous packaging material tube which is subsequently cut and sealed between the mail items.

FR2175230A1 which is equivalent to NL167380 discloses a turning station for a mail item which has been partly wrapped in a banderol. In the known turning station, the mail item is turned around so that the previously leading edge becomes a trailing edge and the previously trailing edge becomes the leading edge. During the turning the trailing part of the banderol sheet is folded around the previously trailing edge which becomes the leading edge so that the trailing part of the banderol sheet is folded against the mail item at the side along which a first part of the banderol sheet extends as well so that the trailing part overlaps the first part and glue which is present on the trailing part of the banderol sheet provides a connection between the first part and the trailing banderol sheet part so as to form the sleeve. The known turning station includes a pivoting pendulum and a pivoting fork assembly. The way in which the banderol sheet is partly folded around the mail item before the mail item with the banderol sheet is supplied to the known turning station is not disclosed in FR2175230A1.

EP2636604 discloses a system for providing a banderol around a mail item. In this system, the mail item is transported in a transport direction and during transport the mail item engages a banderol sheet which is still flat and which extends substantially perpendicular to the transport plane of the mail item. When the mail item is transported further in the transport direction, the banderol sheet is folded around the leading edge of the mail item. A first part is folded against an upper side of the mail item (M) and the second part is folded against a lower side of the mail item. A third part of the sheet (W) is a part of the first part of the sheet (W) that extends in the upstream direction beyond the trailing edge of the mail item. In other words, the third part of the banderol sheet which extend beyond the trailing edge is a continuation of the first part which is folded against the upper side of the mail item, which is contrary to the construction which will be disclosed herein. Subsequently, the mail item with the partly folded banderol sheet is supplied to a turning station of a type which differs substantially from the type known from FR2175230A1. In fact, the turning of the partly wrapped mail item takes place in a sort of a turning mill. The rotational speed of such a turning mill is limited because at high speed the centrifugal forces will cause that the partly wrapped mail items are thrown out of the turning mill. In fact, as is clear from [0013] and [0043] of EP2636604A1, the turning mill disclosed therein rotates intermittently, in contrast to continuously. In fact, it is clear to the skilled person looking at FIG. 3 of EP'604 that insertion of the partly packaged mail item into the turning mill and removal of the turned around mail item from the turning mill can only take place during a temporary standstill of the turning mill. This intermitted movement additionally dictates a limitation on the production capacity.

SUMMARY

The present invention relates to a method and a wrapping module for continuously wrapping mail items in packaging material, be it that the end product is not a mail item which is enclosed in an envelope which is closed around all the edges of the mail item but, instead, a sleeve (D. banderol) extending around the mail item and being open at two opposite edges and of which the width may be smaller than the width of the mail item so that the mail item extends beyond the open edges of the sleeve.

To that end the invention provides a method for providing a sleeve of packaging material around a mail item which comprises a single printed document, e.g. a magazine or a stack of printed documents, e.g. a stack of magazines. The method comprises:

- continuously transporting the mail item with a first transport section in a transport direction along a transport plane, the mail item having a leading edge and a trailing edge;
- supplying a sheet of packaging material to an intermediate position at a downstream end of the first transport section in a second plane which is substantially perpendicular to the transport plane, in which intermediate position the sheet protrudes with a first part above the transport plane and protrudes with a second part below the transport plane and in which the leading edge of the mail item is upstream from the sheet;
- continue to transport the mail item to a second transport section thereby engaging the sheet in the intermediate position with the leading edge and subsequently folding the sheet around the leading edge so that the first part is folded against an upper side of the mail item and the second part is folded against a lower side of the mail item, wherein a third part of the sheet is a part of the second part of the sheet that extends in the upstream direction beyond the trailing edge of the mail item;
- continue to transport the mail item with the second transport section along a glue dispensing station, wherein glue is dispensed on the third part of the sheet;
- continue to transport the mail item with the second transport section to a turning station in which the mail item is turned around so that the previously leading edge becomes a trailing edge and the previously trailing edge becomes the leading edge, and wherein during the turning the third part of the sheet is folded around the previously trailing edge which becomes the leading edge so that the third part of the sheet is folded against the mail item at the side along which the first part of the sheet extends as well and wherein the third part overlaps the first part and the dispensed glue provides a connection between the first part and the third part so as to form the sleeve;

continue to transport the mail item to a third transport section.

The invention also provides a wrapping module for providing a sleeve of packaging material around a mail item which comprises a single printed document, e.g. a magazine or a stack of printed documents, e.g. a stack of magazines. The wrapping module comprises:

a first transport section extending in a transport direction along a transport plane and configured for continuously transporting the mail item in the transport direction along the transport plane, the mail item having a leading edge and a trailing edge;

a sheet supplying station configured for supplying a sheet of packaging material to an intermediate position at a downstream end of the first transport section in a second plane which is substantially perpendicular to the transport, in which intermediate position the sheet protrudes with a first part above the transport plane and protrudes with a second part below the transport plane and in which the leading edge of the mail item is upstream from the sheet;

a second transport section extending in the transport direction along the transport plane and configured for continuously transporting the mail item in the transport direction along the transport plane, the second transport section having an upstream end which is adjacent the downstream end of the first transport section leaving a gap in between through which the sheet is able to pass the transport plane to the intermediate position, wherein the wrapping module is configured such that, when the mail item is transferred from the first transport section to the second transport section, the sheet in the intermediate position is engaged by the leading edge and subsequently the sheet is folded around the leading edge so that the first part is folded against an upper side of the mail item and the second part is folded against a lower side of the mail item, wherein a third part of the sheet is a part of the second part of the sheet that extends in the upstream direction beyond the trailing edge of the mail item;

a glue dispensing station positioned above the second transport section and configured for dispensing glue;

a turning station which is positioned at a downstream end of the second transport section and which configured to turn the mail item around so that the previously leading edge becomes a trailing edge and the previously trailing edge becomes the leading edge, and wherein during the turning the third part of the sheet is folded around the previously trailing edge which becomes the leading edge so that the third part of the sheet is folded against the mail item at the side along which the first part of the sheet extends as well and wherein the third part overlaps the first part and the dispensed glue provides a connection between the first part and the third part so as to form the sleeve of packaging material;

a third transport section having an upstream end which is adjacent to an outlet of the turning station and which is configured to transport the mail item being wrapped in the sleeve further.

With the method and the wrapping module according to the invention a sleeve can be applied around a mail item with high speed. A capacity of 15.000 or even more mail items per hour is feasible with method and wrapping module according to the invention. The sleeve is tightly fit around the mail item, even if the mail item consists of a stack of document and/or magazines. Due to the fact that a sleeve can be used of which the width is less than the width of the mail item, unlike the device and method known from EP 0 526 944 B2 the amount of packaging material that is needed to wrap the mail item can be greatly reduced relative to the known method and wrapping station. This reduction of use of packaging material is beneficial in view of costs and in view of the environmental load.

As stated above, a mail item comprises a single printed document, e.g. a magazine or a stack of printed documents, e.g. a stack of magazines or combinations thereof. A mail item may be distributed by the regular mail distributors, e.g. postal services, but also by special delivery services or in any other manner. The sleeve or the mail item may be provided with a specific mailing address, but it is also feasible that the mail item that is packaged in the sleeve of wrapping material does not have a specific mailing address and is delivered generally in a certain area, e.g. in a city or neighbourhood.

Further embodiments are described in the dependent claims and will be further elucidated with reference to a real example and a schematic example which are shown in the following figures. The examples shown in the figures do not limit the scope of the embodiments claimed in the dependent claims.

DETAILED DESCRIPTION

Figure 11:
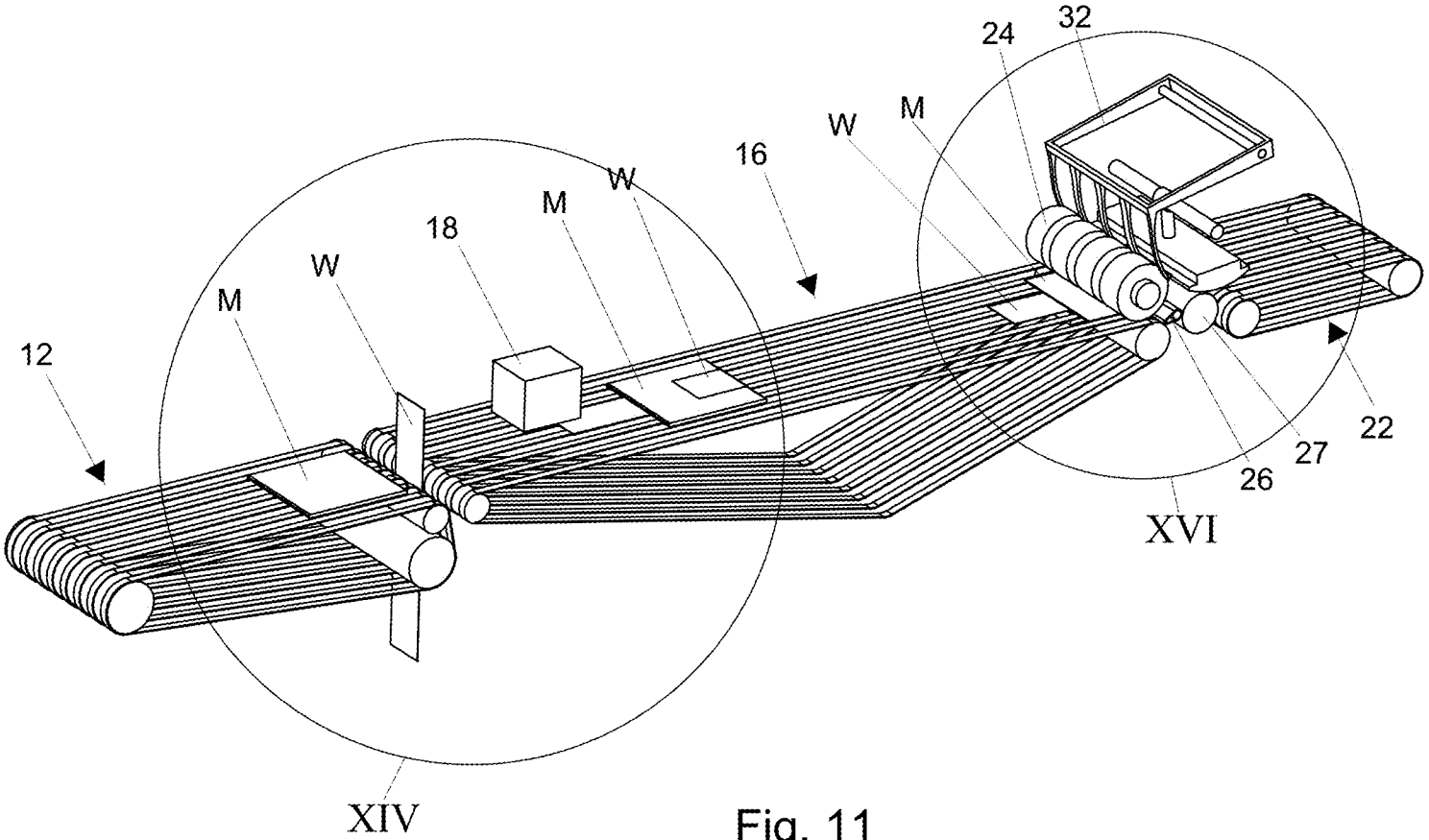
FIG. 11 is a schematic perspective view from the wrapping module viewed from an upstream view point in a downstream direction.
Figure 12:
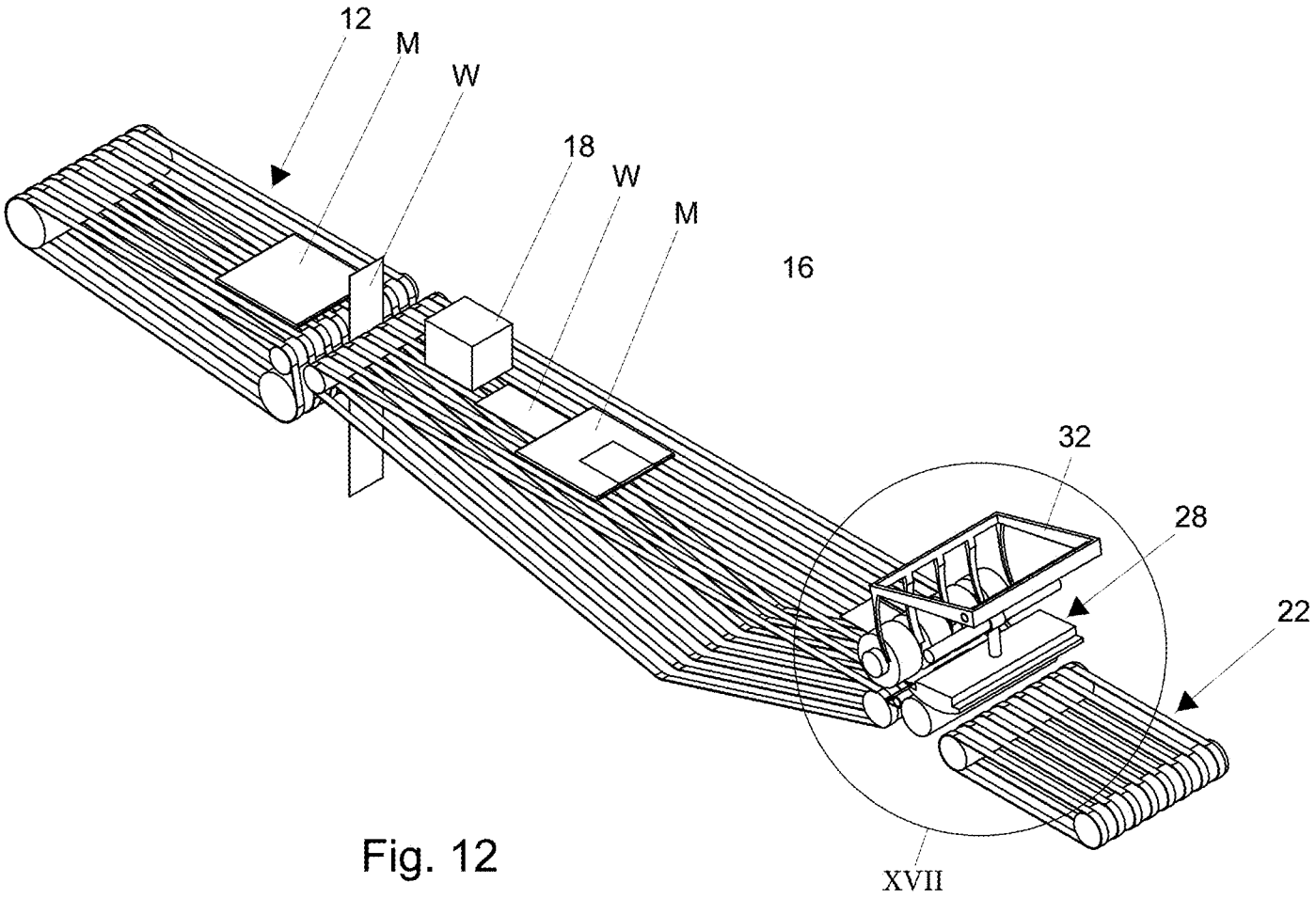
FIG. 12 is a schematic perspective view from the wrapping module viewed from a downstream view point in an upstream direction.
Figure 13:
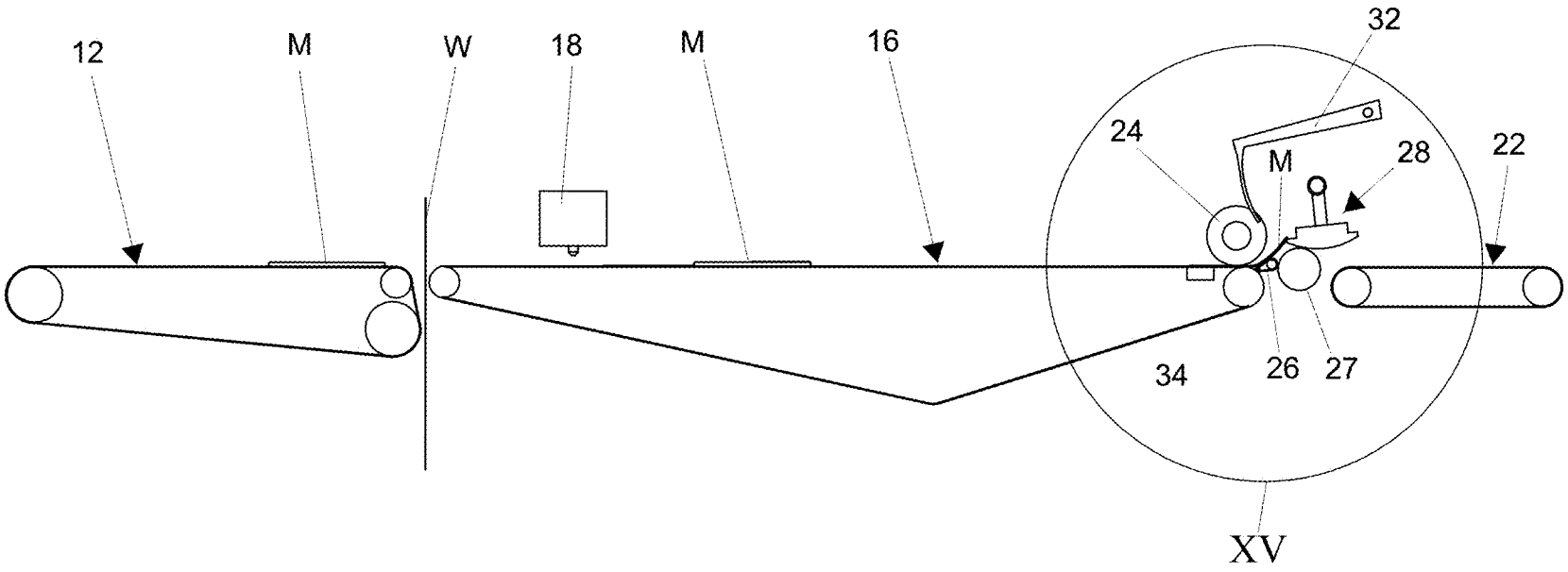
FIG. 13 is a longitudinal cross-sectional view in a vertical plane of the schematically shown wrapping module of FIGS. 11 and 12.

The invention provides a wrapping module 10 for providing a sleeve W of packaging material around a mail item M. A practical example of the wrapping module 10 which includes several of the embodiments to be described is shown in 1-10. FIGS. 11-13 schematically show a wrapping module 10 and details thereof to further elucidate the method for wrapping a mail item M in a wrap W. A mail item M may comprise a single printed document, e.g. a magazine or a stack of printed documents, e.g. a stack of magazines.

In most general terms, the wrapping module 10 comprises a first transport section 12 extending in a transport direction along a transport plane. The first transport section 12 is configured for continuously transporting the mail item M in the transport direction along the transport plane. With the terminology "continuously transporting" a continuous transport is indicated as opposed to an intermittent transport. Within a batch, generally, the continuous transport may be effected with a substantially constant transport speed. However, it is clear that the transport speed may be varied between subsequent batches and even within a batch of mail items to be processed, the transport speed may be varied, for example to optimize the wrapping process and with that the resulting sleeve around the mail item. During transport the mail item M has a leading edge and a trailing edge.

The wrapping module 10 further comprises a sheet supplying station 14 configured for supplying a sheet W of packaging material to an intermediate position at a downstream end of the first transport section 12. The sheet W being in the intermediate position extends in a second plane which is substantially perpendicular to the transport plane. In the intermediate position the sheet W protrudes with a first part above the transport plane and protrudes with a second part below the transport plane. This is clearly shown in FIGS. 11 and 14. The leading edge of the mail item M to be wrapped in that sheet is upstream from the sheet. A second transport section 16 extends in the transport direction along the transport plane and is configured for continuously transporting the mail item M in the transport direction along the transport plane. The second transport section 16 has an upstream end which is adjacent the downstream end of the first transport section 12 leaving a gap in between through which the sheet W is able to pass the transport plane to the intermediate position. The wrapping module 10 is configured such that, when the mail item M is transferred from the first transport section 12 to the second transport section 16, the sheet W in the intermediate position is engaged by the leading edge and subsequently the sheet W is folded around the leading edge so that the first part is folded against an upper side of the mail item M and the second part is folded against a lower side of the mail item M. A third part of the sheet W is a part of the second part of the sheet W that extends in the upstream direction beyond the trailing edge of the mail item M.

The wrapping module comprises a glue dispensing station 18 positioned above the second transport section 16 and configured for dispensing glue. In particular the glue is dispensed on the third part of the wrap W. The wrapping module 10 further comprises a turning station 20 which is positioned at a downstream end of the second transport section 16. The turning station 20 is configured to turn the mail item M around so that the previously leading edge becomes a trailing edge and the previously trailing edge becomes the leading edge. During the turning the third part of the sheet W is folded around the previously trailing edge which becomes the leading edge so that the third part of the sheet W is folded against the mail item M at the side along which the first part of the sheet W extends as well. The third part then overlaps the first part and the dispensed glue provides a connection between the first part and the third part so as to form the sleeve of packaging material.

Finally, the wrapping module comprises a third transport section 22 having an upstream end which is adjacent to an outlet of the turning station 20 and which is configured to transport the mail item M being wrapped in the sleeve W of packaging material further. The further transport of the mail item M may bring the wrapped mail item to another mail item processing station, e.g. a address printing station and/or a stacking station.

Advantages and effects of the wrapping module 10 have been described in the summary section and are considered to be inserted here by this reference.

It should be noted, that in FIGS. 11-23, no upper transport sections are shown because otherwise the mail items M would not be visible. However, in practice, as is visible in FIGS. 3, 4, 5, 6, 9, at least above the first transport section 12 and the second transport section 16 an upper transport system may be provided to prevent that within a stack of documents/magazines forming a mail item M, the documents/magazines may shift due to the high speed and air resistance. Thus, the upper transport system may hold down the mail items and the sheets W partly wrapped around the mail items M. Also above the third transport section 22 such an upper transport system, may be provided. The type of upper transport system may vary, e.g. an upper belt transport system, a set of rollers or combinations thereof.

An embodiment the turning station 20, of which a practical example is shown in FIGS. 1-5 and a schematic example in FIGS. 11-13 and 15-23, comprises a first roller 24 which is positioned above the downstream end of the second transport section 16. A leading edge lifting unit 26 is provided downstream of the downstream end of the second transport section 16 and which is configured to lift a leading edge of the mail item M during transport of the leading edge over the leading edge lifting unit 26. The leading edge lifting unit 26 in the example shown in FIGS. 11-23 is embodied as a small belt drive. Instead, on or a number of parallel rollers may also be used as a leading edge lifting unit 26. Even a plate-like member which is slanted upwardly when looking in the transport direction may be a feasible embodiment of the leading edge lifting unit 26.

The turning station comprises a pendulum 28 which is pivotally mounted along a first pivot axis S1 which extend substantially perpendicular to the transport direction and parallel to the transport plane. The pivotable movement may, for example, be effected by a servo drive motor 64 which is visible in FIG. 5 of the example. A servo drive motor 64 is connected to an electronic controller so that the speed and the exact pivotable movement of the pendulum 28 can be controlled. The pendulum 28 has a pendulum foot 30. The pendulum foot 30 in use contacts the mail item and the sheet W of packaging material. Finally, the turning station comprises a second roller 27 which is positioned downstream of the leading edge lifting unit 26 and which is positioned so as to press the mail item M between the pendulum foot 30 and the second roller 27.

The turning station 20 is configured to lift the leading edge of the mail item M above the transport plane during transport of the leading edge mail item M over the leading edge lifting unit 26. Subsequently the mail item M is engaged by the pendulum foot 30 of the pendulum 28 at a bottom side of the mail item M adjacent the leading edge, while pivoting the pendulum 28 in a first pivot direction P1. The pivot movement of the pendulum 28 is continued in the first pivot direction P1 while pressing the mail item M against the first roller 24 until the previously trailing edge of the mail item M is raised to a level which is equal or slightly higher than an upper side of the circumference of the second roller 27. The turning station 20 is configured to subsequently reverse pivot direction of the pendulum 28 and move the pendulum 28 in a second pivot direction P2 which is opposite the first pivot direction P1, so that the previously trailing edge of the mail item M becomes the leading edge and is moved over the second roller 27. The mail item M is subsequently pressed onto the second roller 27 by the pendulum foot 30 and is transferred to the third transport section 22.

Thus, by turning the mail item M, the sheet W is folded completely over the mail item M both at bottom and the top side of the mail item M so as to form the sleeve of packaging material. Because of the fact that the mail item M with the sleeve wrapped around it is pressed between the second roller 27 and the pendulum foot 30, the connection formed by the glue between the first part and the folded over third part of the sheet W is reinforced.

In a further elaboration of this embodiment, the turning station 20 may comprise a fork assembly 32 which is pivotally mounted along a second pivot axis S2 which extends substantially perpendicular to the transport direction and parallel to the transport plane. The movement of the fork assembly 32 may be effected with a fork assembly servo drive motor 66 which is visible in FIG. 5 of the practical example. Again, the fork assembly servo drive motor 66 may be connected to an electronic controller so that the speed, and the movement range of the fork assembly 32 may be exactly controlled. The fork assembly 32 has a number of fork prongs 42. The first roller 24 has a number of slits through which the fork prongs 42 extend. The fork assembly 32 is configured to pivot downwardly briefly at the moment that the pendulum 28 movement reverses from the first pivot direction P1 to the second pivot direction P2 so that the previously trailing edge of the mail item M is pushed in the transport direction by the fork prongs 42 so as to be transportable over the second roller 27.

Thus, it is even better ensured that, when the pendulum 28 reverses from the first pivot direction P1 to the second pivot direction P2 and starts to move the mail item M downwardly, the previously trailing edge and now leading edge of the mail item M indeed moves over the second roller 27.

In an embodiment, the wrapping module 10 may comprise a suction block 34 which is mounted directly upstream of the turning station 20. The suction block 34 is visible in the practical example in FIG. 4 and in the schematic example in FIGS. 13, 15, 18, 19, 21, 22. The suction block 34 has upwardly directed suction openings 36 which are positioned directly below the transport plane. The wrapping module 10 is configured to activate the suction block 34 at least during passage of the third part of the sheet W over the suction block 34 at which time the leading edge of the mail item M as well as the first and the second part of the sheet W are pressed between the pendulum foot 30 and the first roller 24. Thereby it is effected that the third part of the sheet W is pulled at by air sucked into the suction openings 36 resulting in a tightening of the sheet W along the leading edge and the upper and the lower side of the mail item M.

In an alternative embodiment, instead of a suction block 34, a friction wheel or a similar friction device may be positioned directly upstream of turning station engaging the third part of the sheet W of the mail item M which is pulled into the turning station 20. Such a friction wheel or similar friction device also has the function of tightening the sheet W along the leading edge of the upper and the lower side of the mail item M.

In an embodiment, the wrapping module 10 may comprise a reel 38 of including a web B of packaging material, a cutting station 40 to cut separate sheets W of packaging material from the web B of packaging material, as well as a sheet magazine 44 in which the sheets W cut from the web B are stacked on top of each other. In the figures showing the practical example, the reel 38 and the cutting station 40 are visible in FIGS. 1 and 2. The sheet magazine 44 is also visible in FIGS. 1 and 2 and additionally in FIGS. 3 and 6-9.

From the reel 38 including the web B of packaging material a very large number of sheets W can be produced. For example, when the wrapping module 10 produces at, for example, 8000 mail items per hour, one reel 38 may suffice, for example, for one or a few days of production. Thus, the reel 38 only has to be exchanged very few times and the loss of production time is minimized due to such action. Preferably, the reel 38 has a width which substantially corresponds to the length of the sheets W to be produced. Thus, in such an embodiment the cutting station 40 merely needs a single cutting knife (not shown) which extends parallel to the transport direction. After cutting, the sheet W may be transported to the sheet magazine 44 which is positioned at the end of a transport belt section of the cutting station 40. However, in an alternative embodiment, the cutting station 40 may include a second knife that extends perpendicular to the first cutting knife so that the length of the sheets W may be cut shorter than the width of the web B on the reel 38.

The cutting knife of the cutting station 40 may, for example, be embodied as a rotating cutting knife.

In an embodiment, the cutting station 40 may comprise a cutting knife of which the cutting frequency is adjustable so as to adjust the width of the sheet W of packaging material that is produced by the cutting station.

In the embodiment of a rotating cutting knife, the cutting frequency will be adjusted by adjustment of the rotational speed of the rotating cutting knife. However, also a reciprocating cutting knife is feasible. In that case, the motor driving the reciprocating movement may have a variable driving speed.

Figure 10:
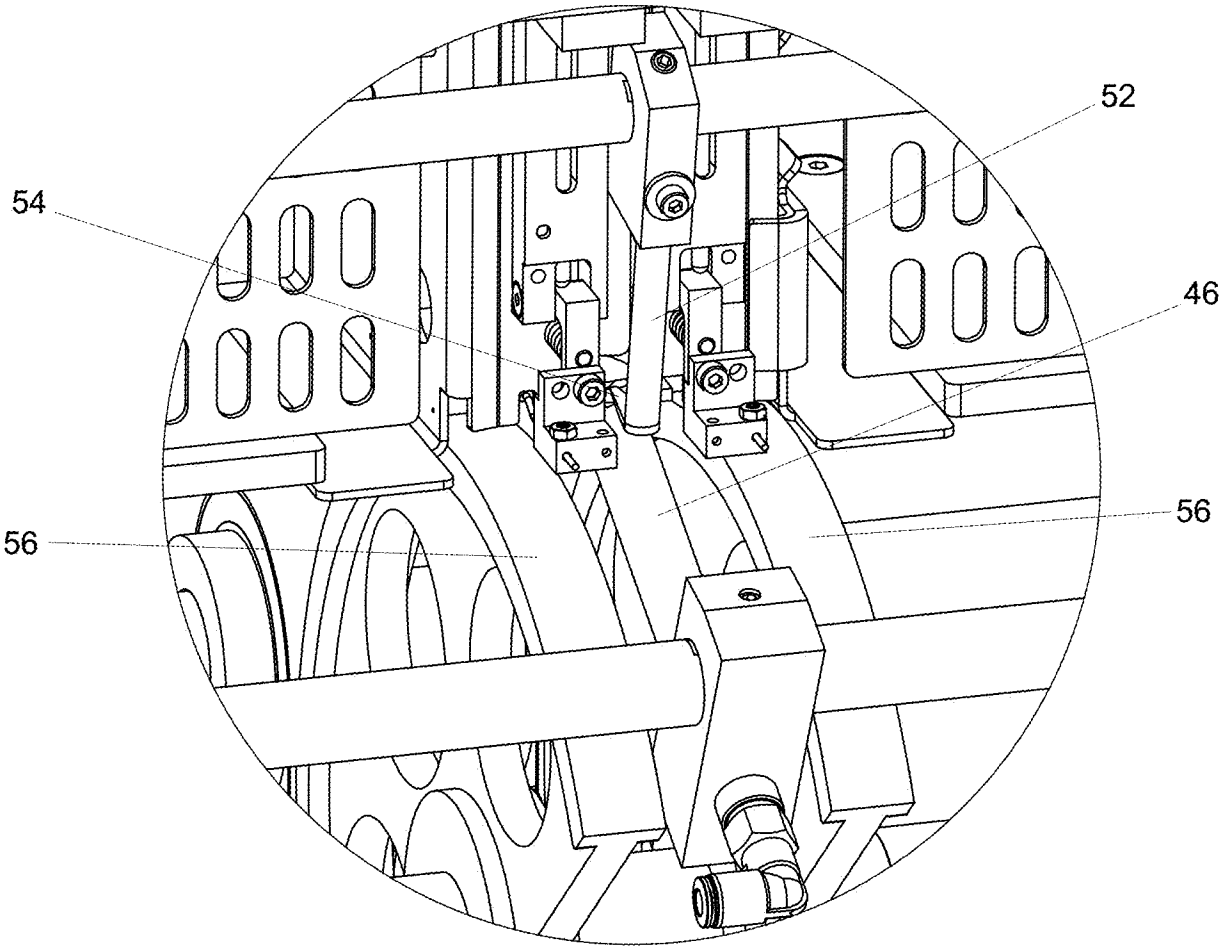
FIG. 10 is detail X from FIG. 9.

In an embodiment, the wrapping module 10 may comprise a sheet supplying station 14. In the figures showing the practical example, the sheet supplying station 14 is visible in FIGS. 1, 2, 3, 6, 9 and details thereof in FIGS. 7, 8 and 10. The sheet supplying station 14 of this embodiment comprises the sheet magazine 44 for storing a stack of sheets. Further, the sheet supplying station 14 comprises a first pivotable arm 46 at the end of which a suction head 48 is provided having a concave upper surface 50 (see in particular FIGS. 7 and 8). A second pivotable arm 52 is also part of the sheet supplying station 14. At the end of the second pivotable arm 52 a stack supporting member 54 is provided. The sheet supplying station 14 additionally comprises at least one transport wheel 56 which has a cut-out 62 along the circumference as well as a pressure roller or pressure belt 59 which is positioned opposite the transport wheel 56. Guides 58 are provided for guiding the sheet W along the second plane.

Optionally, instead of a single suction head 48, two or more suction heads may be provided, for example each suction head being mounted on its own pivotable arm. Or more than one suction heads being provided on a single pivotable arm. An embodiment with two suction heads of which the first one may be embodied as shown in the figures and a second one may be embodied as a conventional suction cup mounted on the first pivotable arm 46 as well or on an additional pivotable arm may be beneficial for the separation of the bottom sheet W from the stack of sheets W.

Figure 14:
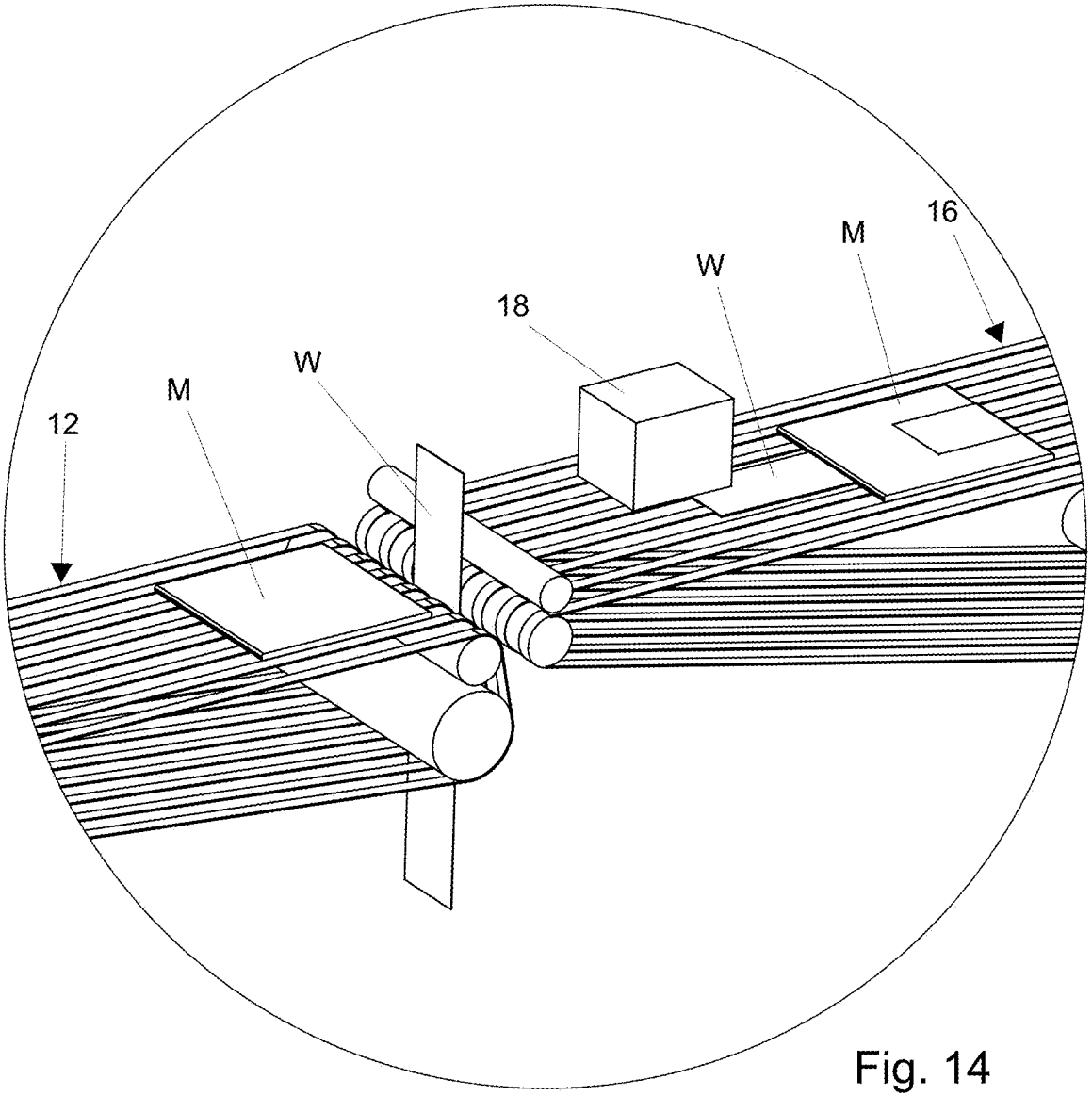
FIG. 14 is detail XIV from FIG. 11.

For supplying the sheet W to the intermediate position shown in FIG. 14, the sheet supplying station 14 is configured to:

- pivot the second pivotable arm 52 from a start position to a retracted position so that a lowest sheet W of the stack of sheets is supported at one lower edge of the stack exclusively by the suction head 48;
- activate the suction head 48 so that the lowest sheet W is locally sucked downwardly against the concave upper surface 50 of the suction head 48 thereby creating a space between the lowest sheet W and a sheet W which is directly above the lowest sheet W in the stack;
- pivot the second pivotable arm 52 to the start position so that the stack supporting member 54 extends in said space which has been created and supports the remaining stack of sheets;
- pivot the first pivotable arm 46 from a support position to a downward position in which an edge of the lowest sheet W which is held by the suction head 48 is moved into the cut-out 62 in the transport wheel 56; and
- rotate the transport wheel 56 so that the sheet W is engaged between the transport wheel 56 and the pressure roller or pressure belt (59) so as to be moved along the guides 58 in the second plane for further transport towards said intermediate position.

Thus, the lowest sheet W of the stack of sheets W in the sheet magazine 44 may effectively drawn out of the sheet magazine 44 and be flawlessly transported towards the intermediate position. The height at which the sheet W stops moving, i.e. the exact position of the intermediate position relative to the transport plane may be adjustable by stops and/or an electronic control of the transport means which may be positioned along the guides 58.

In a further elaboration of this embodiment, the sheet supplying station 14 may comprise transport rollers and/or a transport belt 60 configured to accelerate the sheet W so as to transport the sheet W along the guides 58 and move it through a gap between two subsequent mail items M to the intermediate position. The time available to move a sheet W in a gap between two subsequent mail items M is very short, especially when the production speed of the packaging process raises up to 15.000 mail items per hour. By way of example: the gap between subsequent mail items may e.g. be 20 cm whereas the mail items may have a length of e.g. 30 cm. In this example, the transport speed of the mail items is approximately 7.500 meter per hour. A gap of 20 cm between subsequent mail items M will pass the gap between the first transport section 12 and the second transport section 16 in about 0.1 second. To have some play, the sheet W, which will in this example have a length of approximately 80 cm, should move at an average speed of at least 5 meter per second, i.e. 18 km/h. Coming from a standstill in the sheet magazine 44, it will be clear that a substantially quick acceleration is needed. The intermediate position relative to the transport plane may be adjustable by a precise control of the transport rollers or the transport belt 60. In the detail shown in FIG. 6 of the practical example, a pressure belt 59 opposite the transport wheel 56 and transport rollers 60 positioned along the guides 58 are visible.

In an embodiment, of which an example is visible in FIGS. 1 and 3-5, the position of the first swivel axis S1 of the pendulum 28 may adjustable. By adjusting the position of the swivel axis S1, mail items M of different thicknesses may be processed.

In an embodiment, the turning station 20 may comprise a third drive 68 (see FIGS. 4 and 5) which is configured to adjust the position of the swivel axis S1 of the pendulum 28. Thus, an automated adjustment of the position of the swivel axis S1 of the pendulum 28 may be effected, e.g. on the basis of an inputted mail item thickness into the electronic controller of the wrapping module 10. With this embodiment it is possible to adjust the position of the first swivel axis S1 on the fly, that is while producing so that subsequent mail items M within a production batch may have variable thickness. In order to move the mail items M with varying thickness between the downstream pulley of the second belt section 16 and the first roller 24, the downstream pulley of the second belt section 16 may be movably mounted in a vertical direction and be biased by spring force in the direction of the first roller 24. When a thick mail item M passes the first roller 24, the downstream pulley of the second belt section 16 may be pushed downwardly against the biasing force pushing the downstream pulley upwardly.

In an embodiment, the leading edge lifting unit 26 and the second roller 27 may mounted so as to be pivotable below the transport plane. In this embodiment, a second packaging module of a different type may be provided downstream of the wrapping module 10. The second packaging module which may be provided downstream of the wrapping module 10 may, for example, be configured to package the mail items in a closed paper or plastic foil packaging of which an examples are described in EP 0 526 944 B2 and EP 1 621 461 A1. When a closed packaging around the mail items M is desired, the leading edge lifting unit 26 and the second roller 27 are pivoted in a position below the transport plane and the supply of sheets W by sheet supplying station 14 is stopped. Also, the driving of the pendulum 28 and the driving of the fork assembly 32 is stopped. In this condition, mail items M will simply pass the packaging module 10 and subsequently arrive at the second packaging module of the different type so as to be packaged in another type of packaging. Thus, a packaging line is provided in which mail items may be packaged in a sleeve or, for example, in a completely closed packaging.

Figure 21:
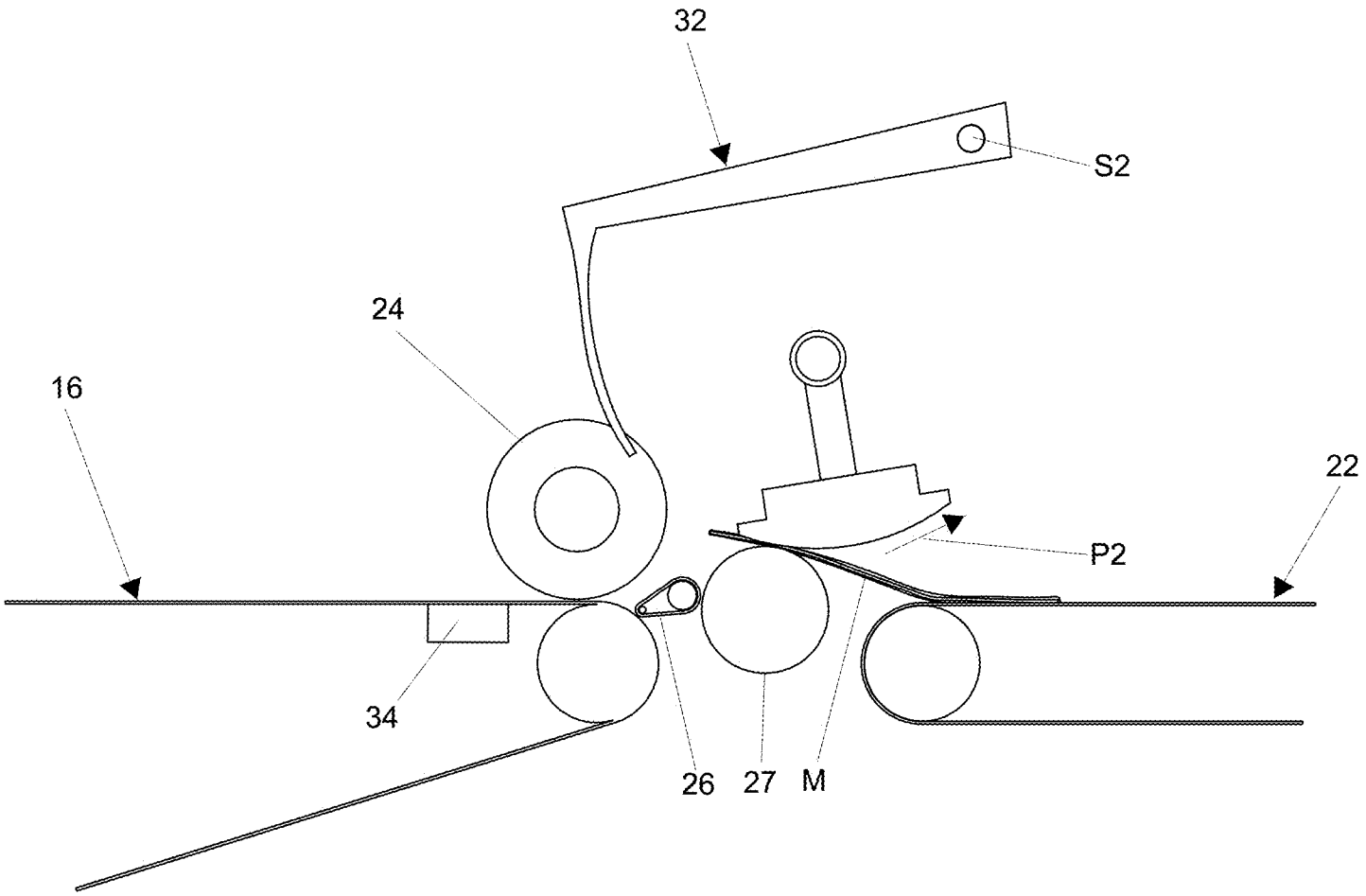
FIG. 21 is detail XV from FIG. 13 in the situation in which the pendulum has reversed from the first pivoting direction to the second pivoting direction and the mail item with the sleeve wrapped around it is transported to the third transport section.
Figure 22:
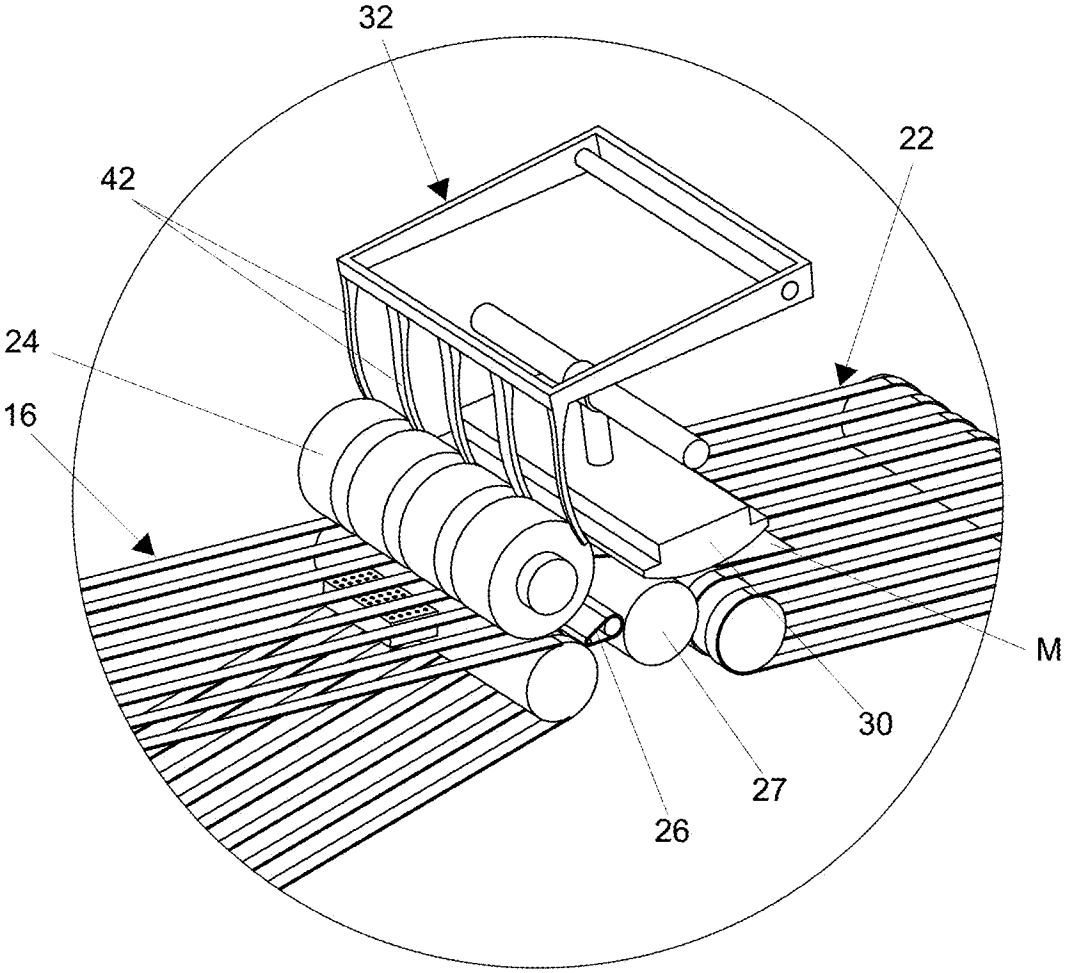
FIG. 22 is detail XVI from FIG. 11 in the situation in which the pendulum has reversed from the first pivoting direction to the second pivoting direction and the mail item with the sleeve wrapped around it is transported to the third transport section.
Figure 23:
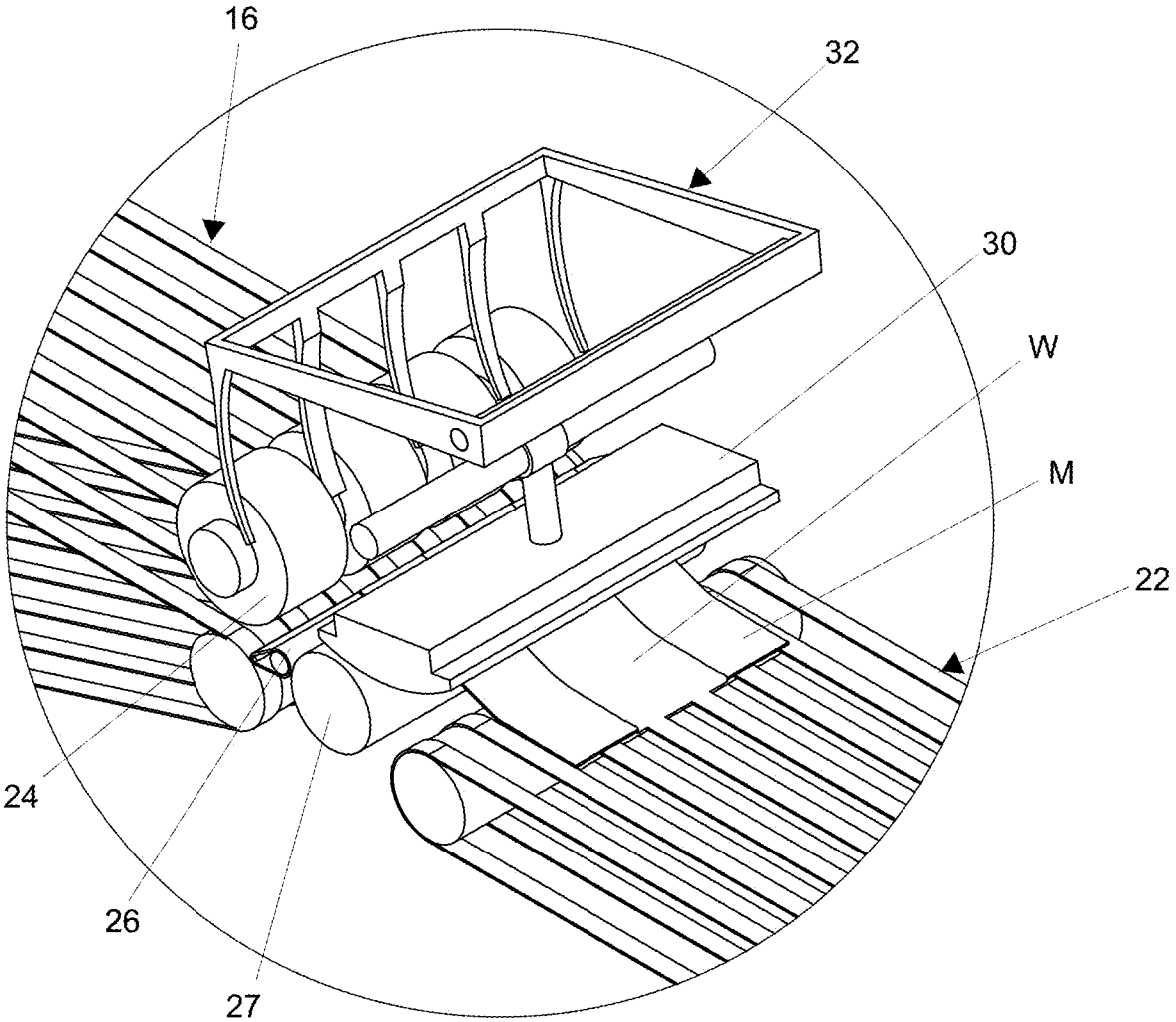
FIG. 23 is detail XVII from FIG. 12 in the situation in which the pendulum has reversed from the first pivoting direction to the second pivoting direction and the mail item with the sleeve wrapped around it is transported to the third transport section.

The invention also provides a method for providing a sleeve W of packaging material around a mail item M. The mail item M may comprise a single printed document, e.g. a magazine or a stack of printed documents, e.g. a stack of magazines. In most general terms the method comprises:

- continuously transporting the mail item M with the first transport section 12 in a transport direction along a transport plane, the mail item M having a leading edge and a trailing edge (see FIGS. 11-13);
- supplying a sheet W of packaging material to an intermediate position at a downstream end of the first transport section 12 in the second plane which is substantially perpendicular to the transport plane, in which intermediate position the sheet W protrudes with a first part above the transport plane and protrudes with a second part below the transport plane and in which the leading edge of the mail item M is upstream from the sheet W (see FIGS. 11-14);
- continue to transport the mail item M to the second transport section 16 thereby engaging the sheet W in the intermediate position with the leading edge and subsequently folding the sheet W around the leading edge so that the first part is folded against an upper side of the mail item M and the second part is folded against a lower side of the mail item, and the third part of the sheet W which is a part of the second part of the sheet W extending in the upstream direction beyond the trailing edge of the mail item (see the mail item M in approximately in the middle of the second transport section 16 in FIGS. 11-14);
- continue to transport the mail item M with the second transport section 16 along the glue dispensing station 18, wherein glue is dispensed on the third part of the sheet (see the glue dispensing station 18 in FIGS. 11-14);
- continue to transport the mail item M with the second transport section 16 to the turning station 20 in which the mail item M is turned around so that the previously leading edge becomes a trailing edge and the previously trailing edge becomes the leading edge, and wherein during the turning the third part of the wrap W is folded around the previously trailing edge which becomes the leading edge so that the third part of the sheet W is folded against the mail item M at the side along which the first part of the sheet W extends as well and wherein the third part overlaps the first part and the dispensed glue provides a connection between the first part and the third part so as to form the sleeve of packaging material (see FIGS. 11-23); and
- continue to transport the mail item M to the third transport section (see FIGS. 21-23).

Advantages and effects of the method are described in the summary section and are considered to be inserted here by this reference.

In an embodiment of the method, the wrapping material may be chosen from the group consisting of paper, a plastic foil or metal foil, and a laminate of paper and plastic and/or metal foil.

From an environmental point of view, the use of paper as wrapping material is preferred in the marked, even though some plastics also have good environmental qualities. It is of importance that when plastic foil or metal foil are used, that the stiffness thereof is sufficient to be able to be subjected to the various stages of the method. In particular, a stiffness which is comparable to that of a sheet of paper having a weight of at least 20 g/m$^2$ is desirable.

Figure 15:
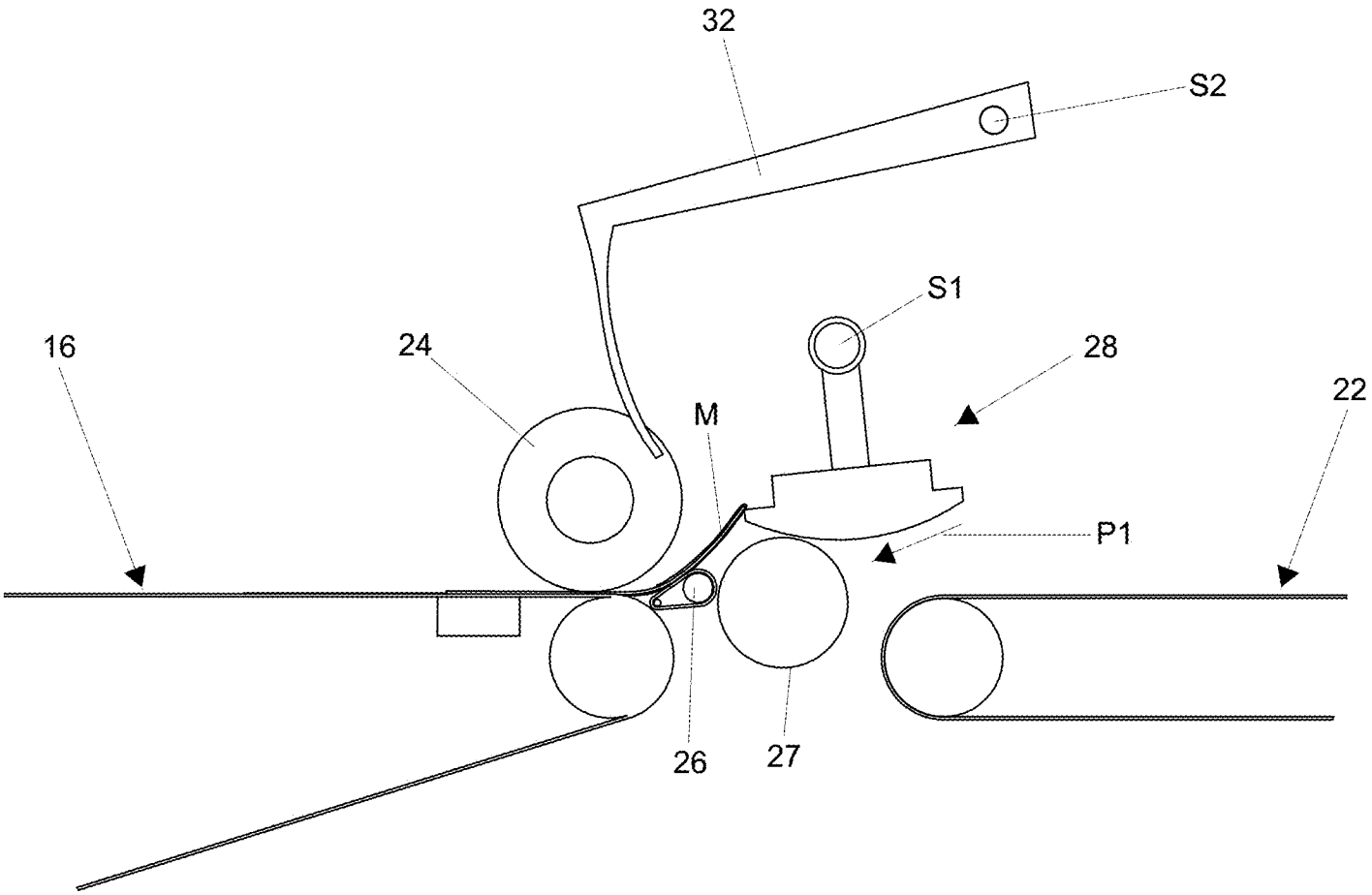
FIG. 15 is detail XV from FIG. 13 in the situation in which the leading edge of the mail item is lifted above the transport plane by the leading edge lifting unit.
Figure 16:
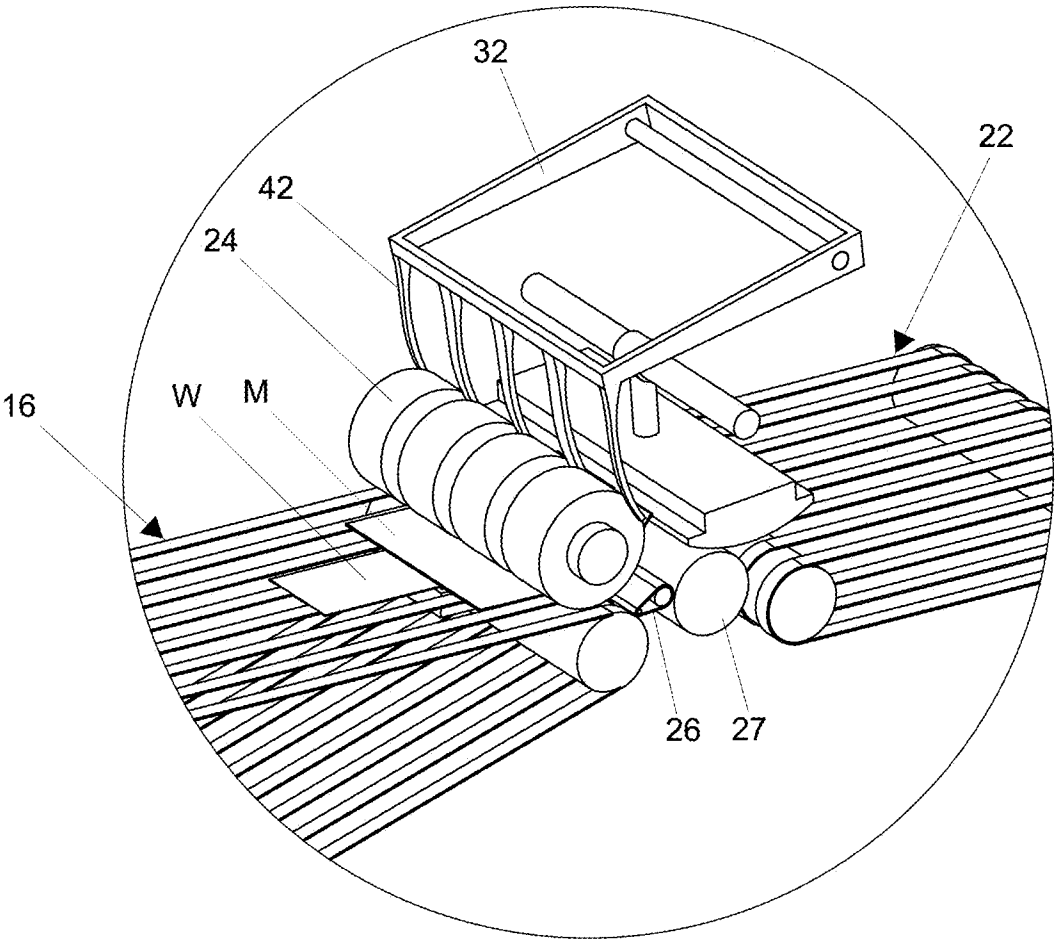
FIG. 16 is detail XVI from FIG. 11 in the situation in which the leading edge of the mail item is lifted above the transport plane by the leading edge lifting unit.
Figure 17:
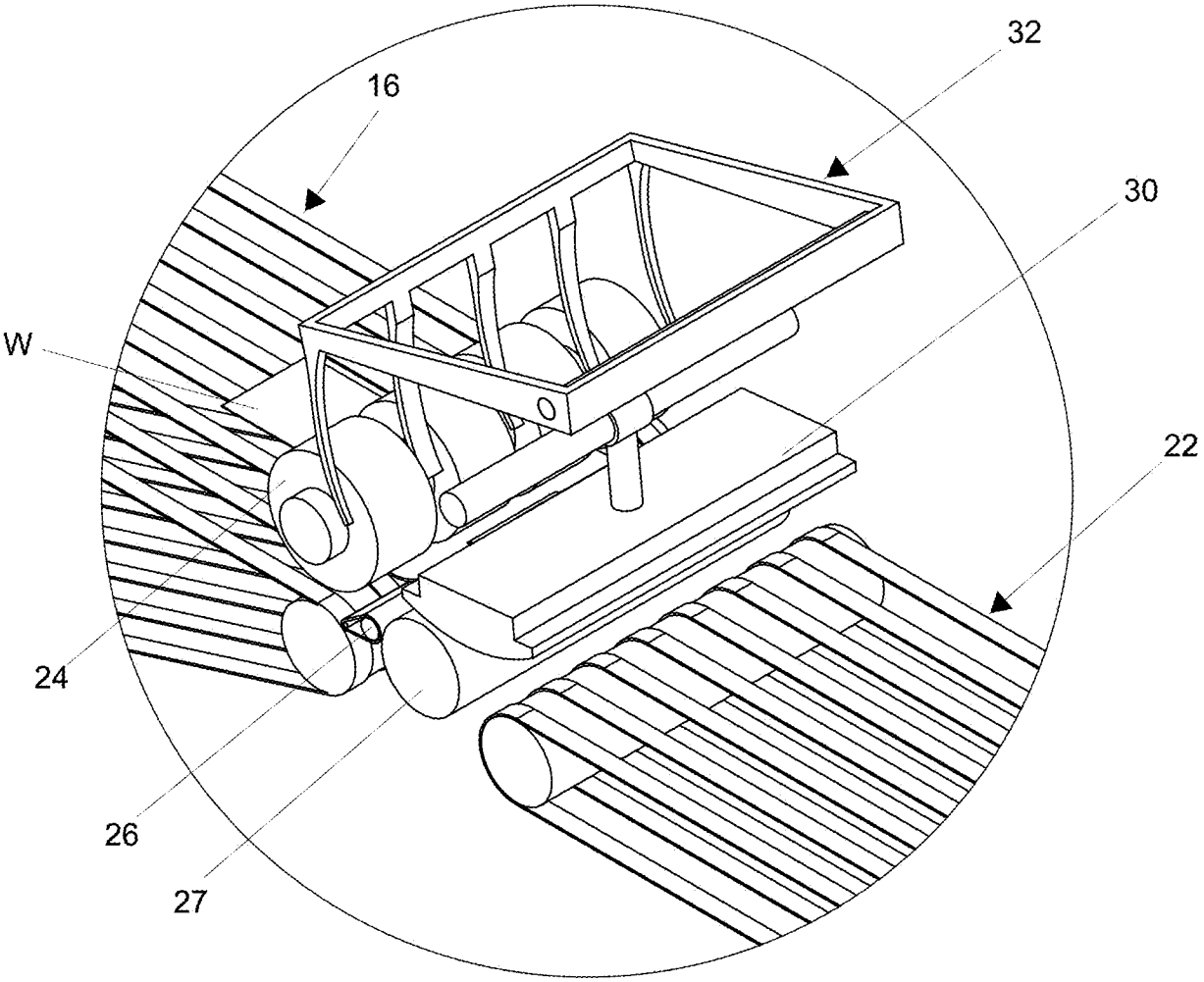
FIG. 17 is detail XVII from FIG. 12 in the situation in which the leading edge of the mail item is lifted above the transport plane by the leading edge lifting unit.
Figure 18:
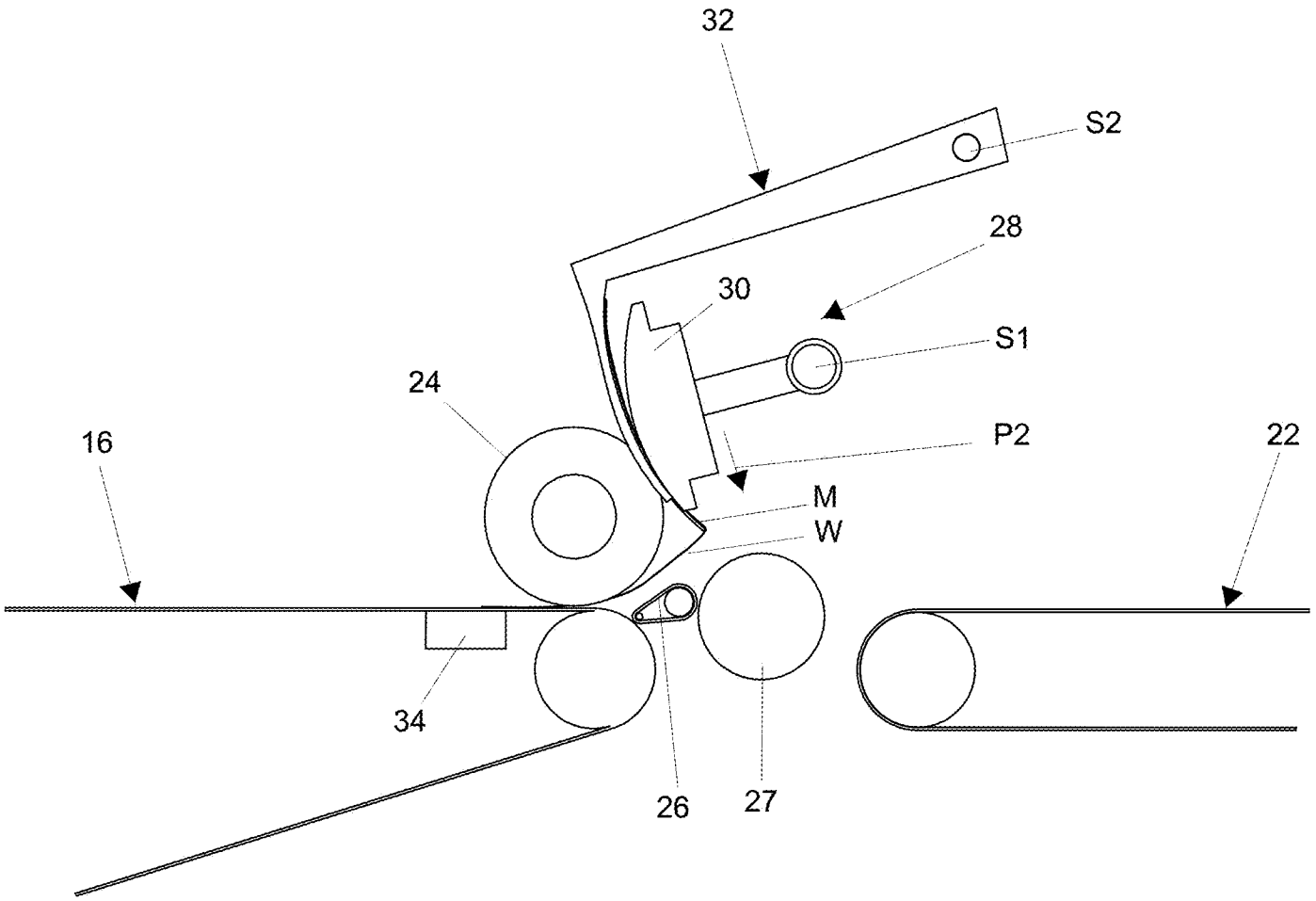
FIG. 18 is detail XV from FIG. 13 in the situation in which the leading edge of the mail item has been moved by the pendulum to its top position and in which the fork assembly is briefly moved downwardly to flip the previously trailing edge of the mail item in the transport direction.
Figure 19:
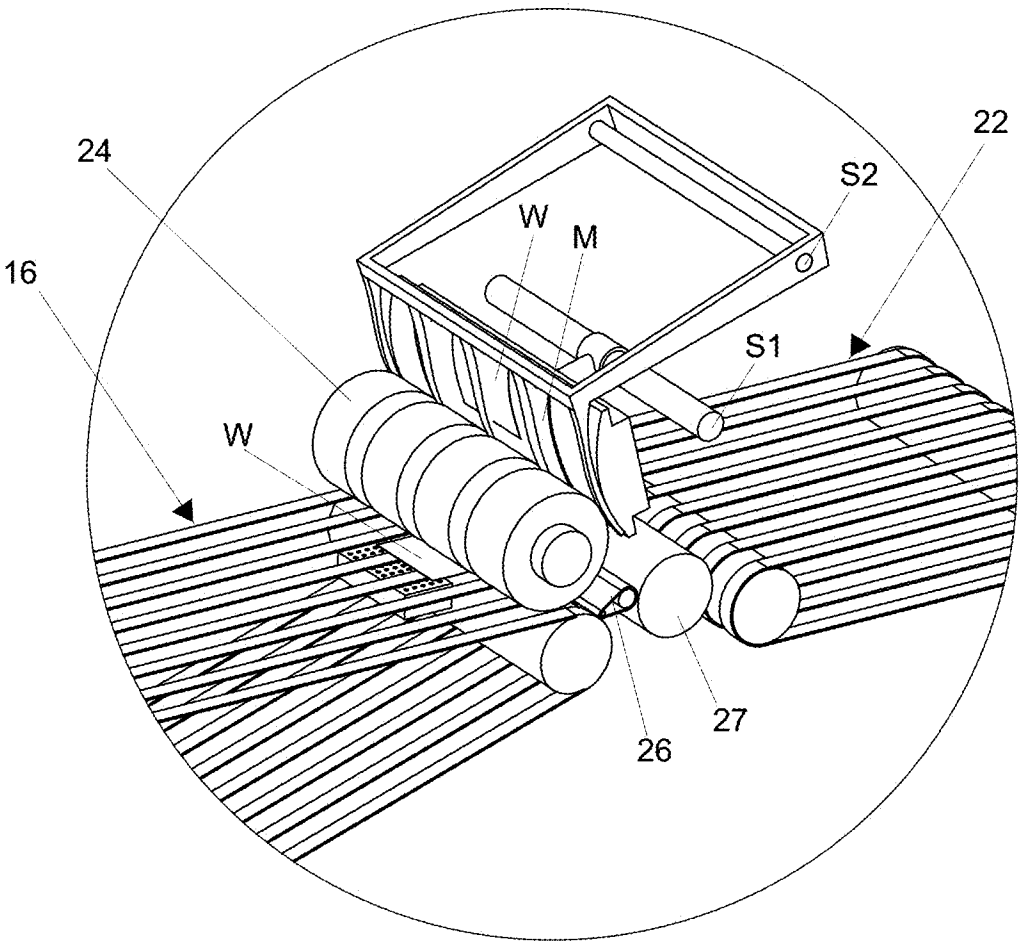
FIG. 19 is detail XVI from Fig. in the situation in which the leading edge of the mail item has been moved by the pendulum to its top position and in which the fork assembly is briefly moved downwardly to flip the previously trailing edge of the mail item in the transport direction.
Figure 20:
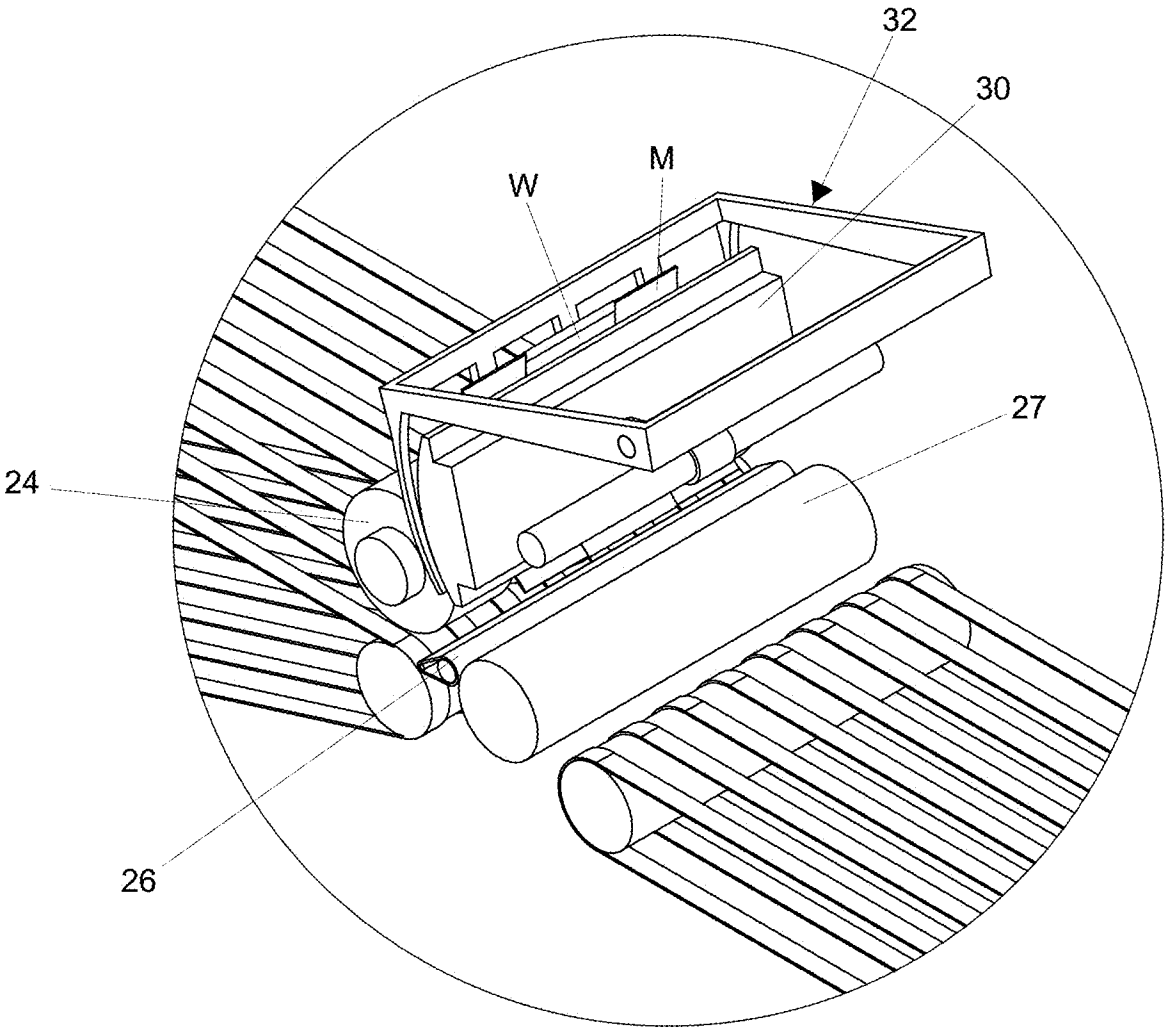
FIG. 20 is detail XVII from FIG. 12 in the situation in which the leading edge of the mail item has been moved by the pendulum to its top position and in which the fork assembly is briefly moved downwardly to flip the previously trailing edge of the mail item in the transport direction.

In an embodiment of the method, the turning of the mail item M is effected by transporting the leading edge of the mail to the leading edge lifting unit 26 so that the leading edge is lifted above the transport plane (see FIGS. 15-17). Subsequently the mail item M is engaged by the pendulum foot 30 of the pendulum 28 at a bottom side of the mail item M adjacent the leading edge while the pendulum 28 pivots in a first pivot direction P1 (see FIGS. 15-17). Subsequently, the pendulum 28 continues to pivot in the first pivot direction P1 while pressing the mail item M against the first roller 24 until the previously trailing edge of the mail item M is raised to a level which is equal or slightly higher than an upper side of the circumference of the second roller 27 (see FIGS. 18-20). Then, the pivot direction of the pendulum 28 reverses and the pendulum 28 pivots in a second pivot direction P2 which is opposite the first pivot direction P1, so that the previously trailing edge of the mail item M becomes the leading edge and is moved over the second roller 27. During further movement of the mail item M over the second roller 27, the mail item M is pressed onto the second roller 27 by the pendulum foot 30 and is transferred to the third transport section 22 (see FIGS. 21-23).

By virtue of this embodiment of the method, the third part is continued to be pressed on the first part of the sheet thereby extending the pressing time and thus improving the strength of the glue connection between the third part and the first part of the sheet W.

In the embodiment of the wrapping module 10 comprising the fork assembly 32 as described above, the fork assembly 32 pivots downwardly briefly (see FIGS. 18-20) at the moment that the pendulum 28 movement reverses from the first pivot direction P1 to the second pivot direction P2 so that the previously trailing edge of the mail item M is pushed in the transport direction by the fork prongs 42 so as to be transportable over the second roller 27.

This additionally reduces the chance that the previously trailing edge of the mail item M does not pass over the second roller 27 firstly to become the new leading edge of the mail item M. Thus, the fork assembly 32 promotes the reliability of the turning operation.

In the embodiment of the wrapping module 10 comprising the suction block 34 as described above, an embodiment of the method comprises at least activating the suction block 34 during passage of the third part of the sheet W over the suction block 34 at which time the leading edge of the mail item M as well as the first and the second part of the sheet W are pressed between the pendulum foot 30 and the first roller 24 thereby effecting that the third part of the sheet W is pulled at by air sucked into the suction openings 36 resulting in a tightening of the sheet W along the leading edge and the upper and the lower side of the mail item M.

A tight sleeve W around the mail item M is what clients wish to have and what the postal services prefer to handle. The method with the suction action on the third part of the sheet W provides such a tight sleeve W.

In the embodiment of the wrapping module 10 comprising the reel 38, the cutting station 40 and the sheet magazine 44, the method comprises transporting the web B from the reel 38 to the cutting station 40, cutting separate sheets W from the web B of packaging material in the cutting station, and placing the sheets W in the sheet magazine 44 in which the sheets are stacked on top of each other.

In a further elaboration of this embodiment, the web B extends in a longitudinal direction and the web B has a width which is equal to a width of the reel 38. The method comprises transversely cutting the sheets W from the web B with the cutting station 40, wherein a length of each sheet W extending in the transport direction is equal to a width of the web B.

Figure 1:
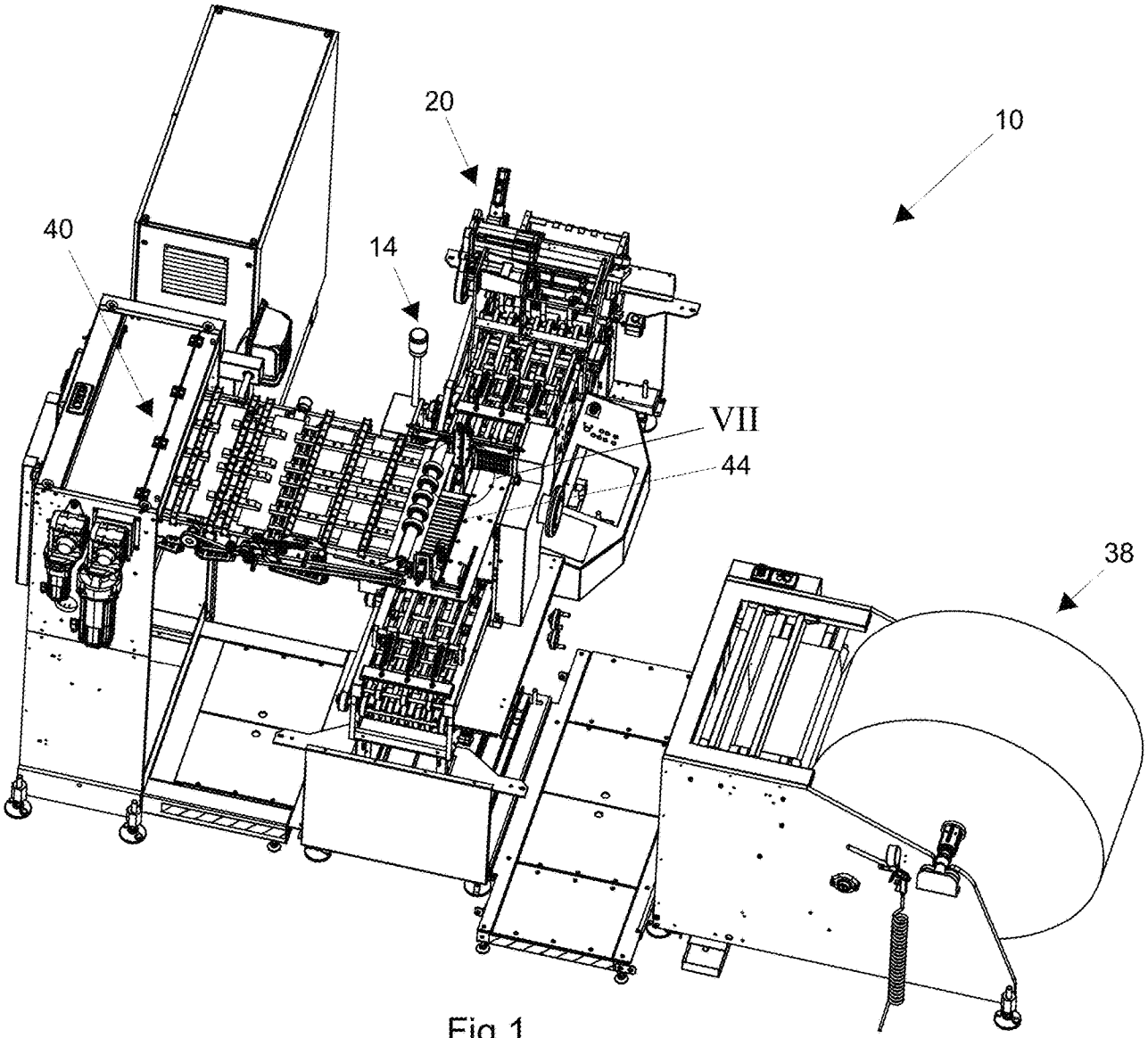
FIG. 1 is a perspective view of an example of a wrapping module.
Figure 2:
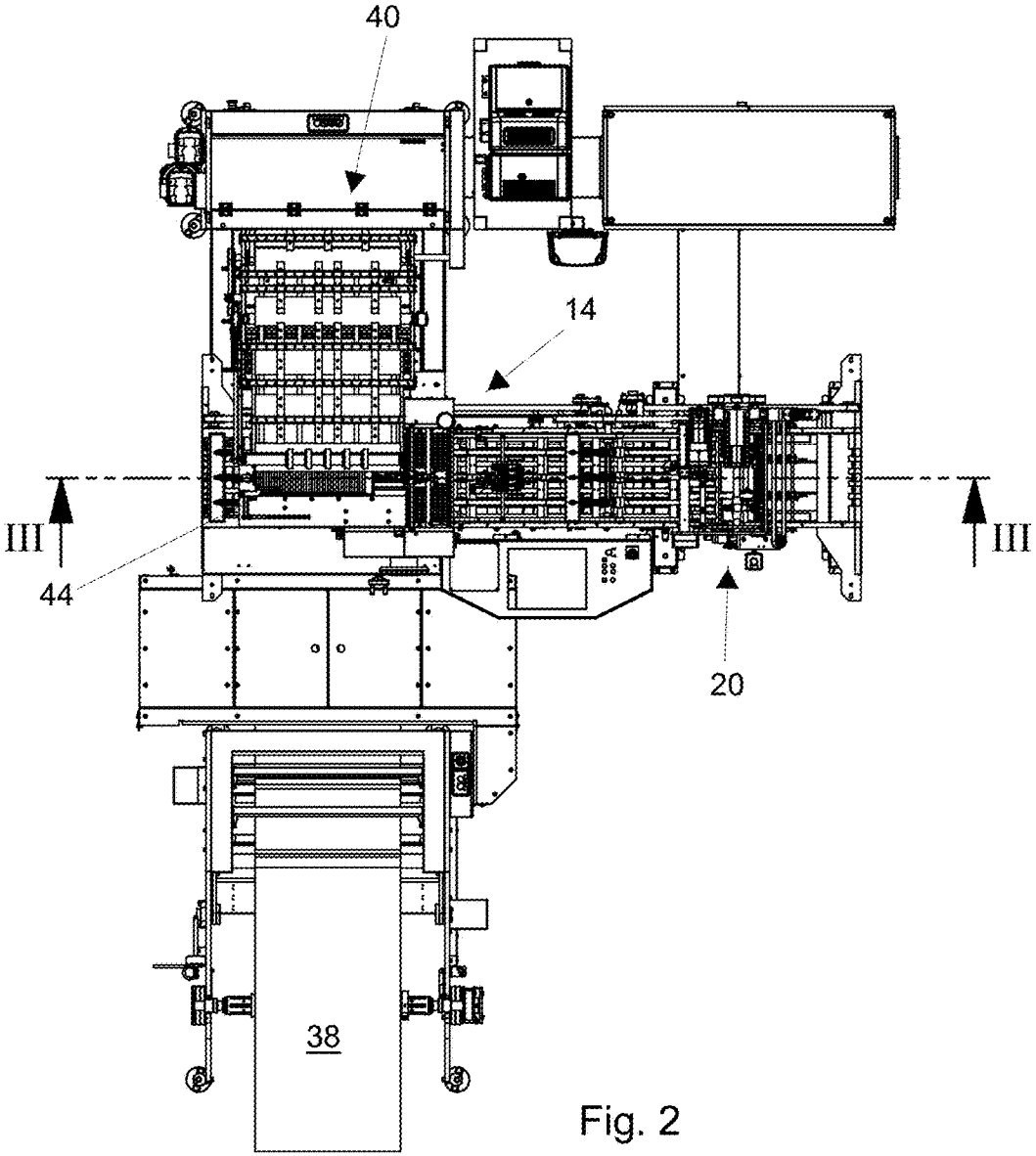
FIG. 2 is a top view of the example of FIG. 1.
Figure 3:
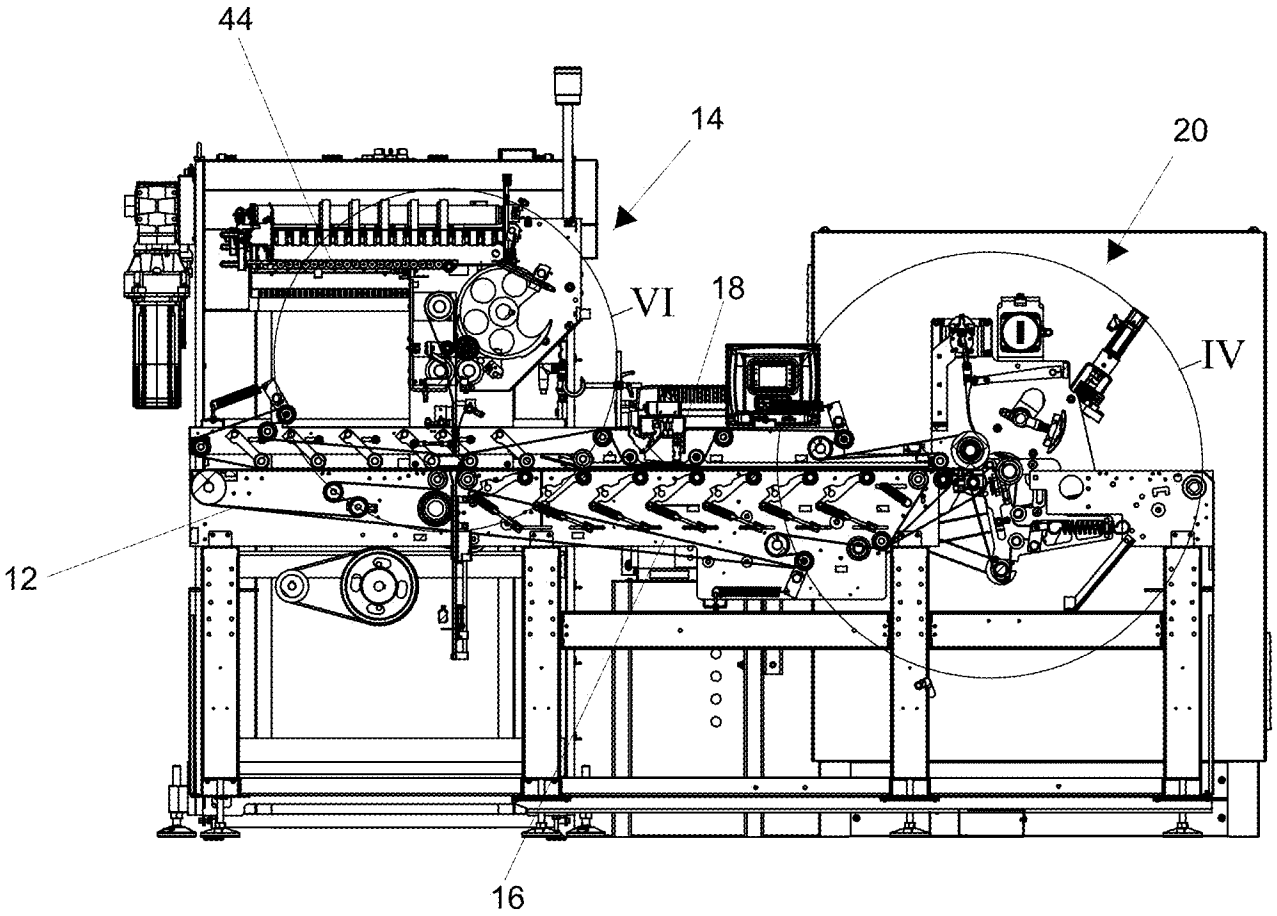
FIG. 3 is cross sectional view over line III-III in FIG. 2
Figure 4:
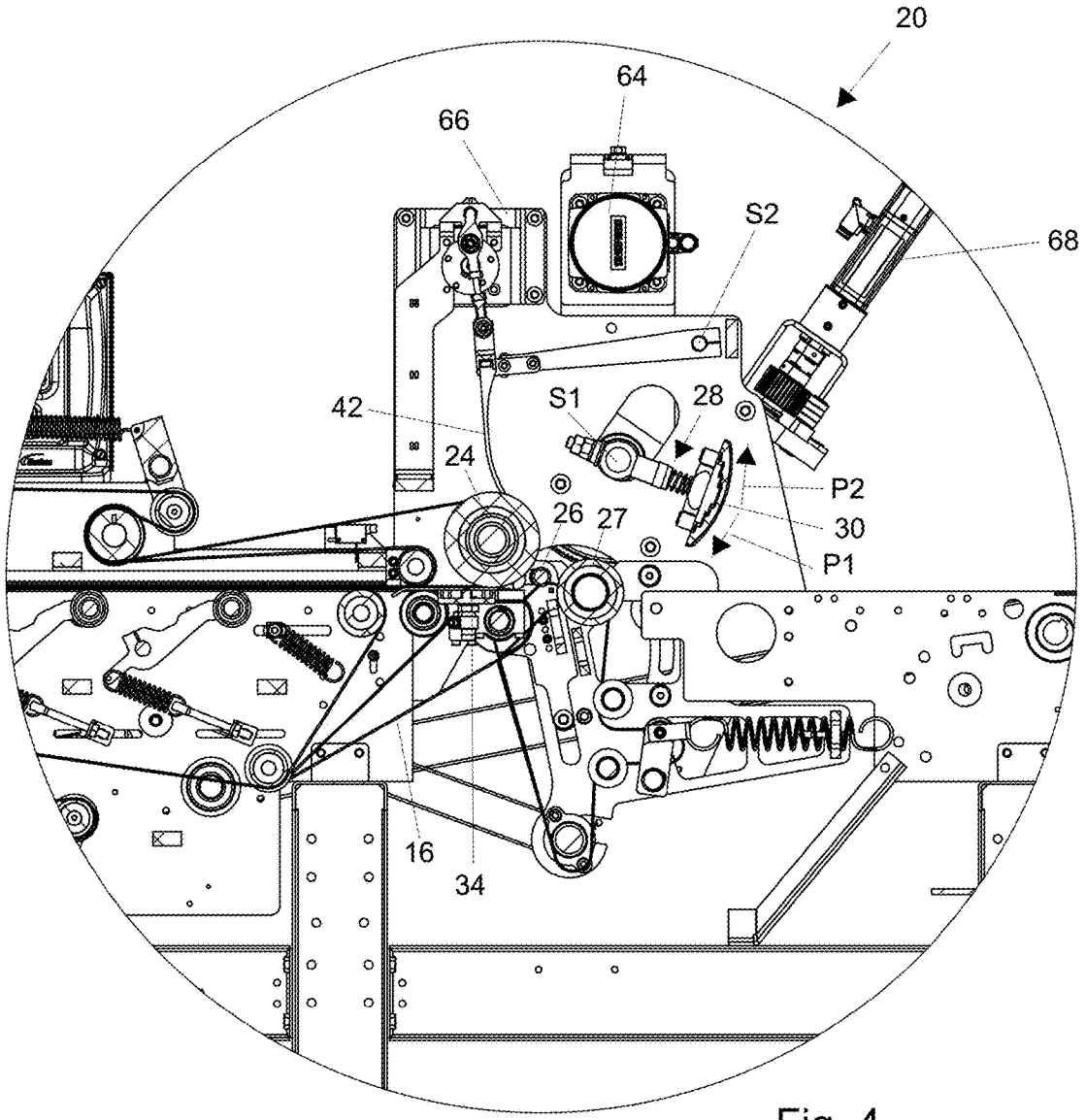
FIG. 4 is detail IV from FIG. 3.
Figure 5:
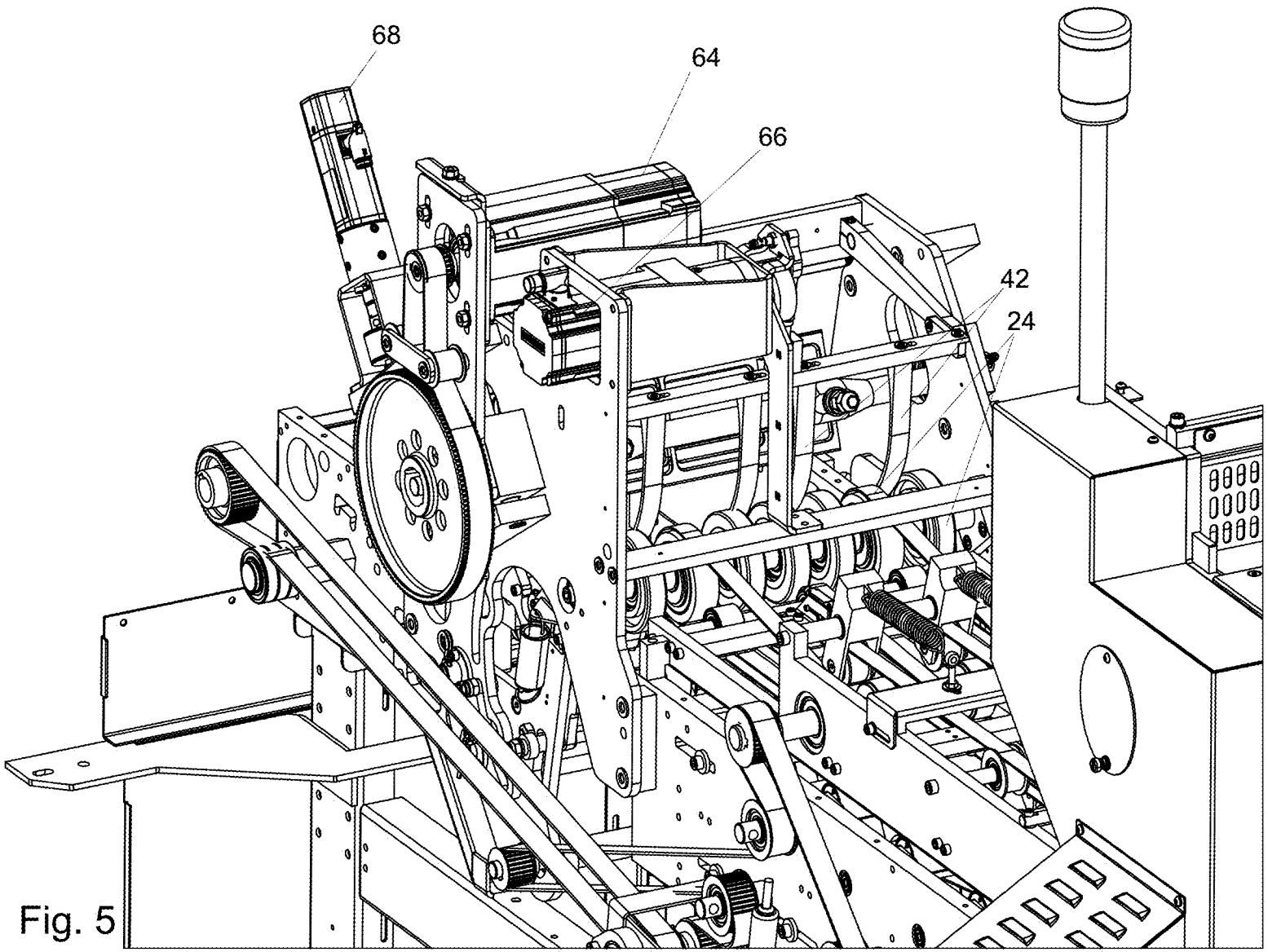
FIG. 5 is a perspective view from the turning station.
Figure 6:
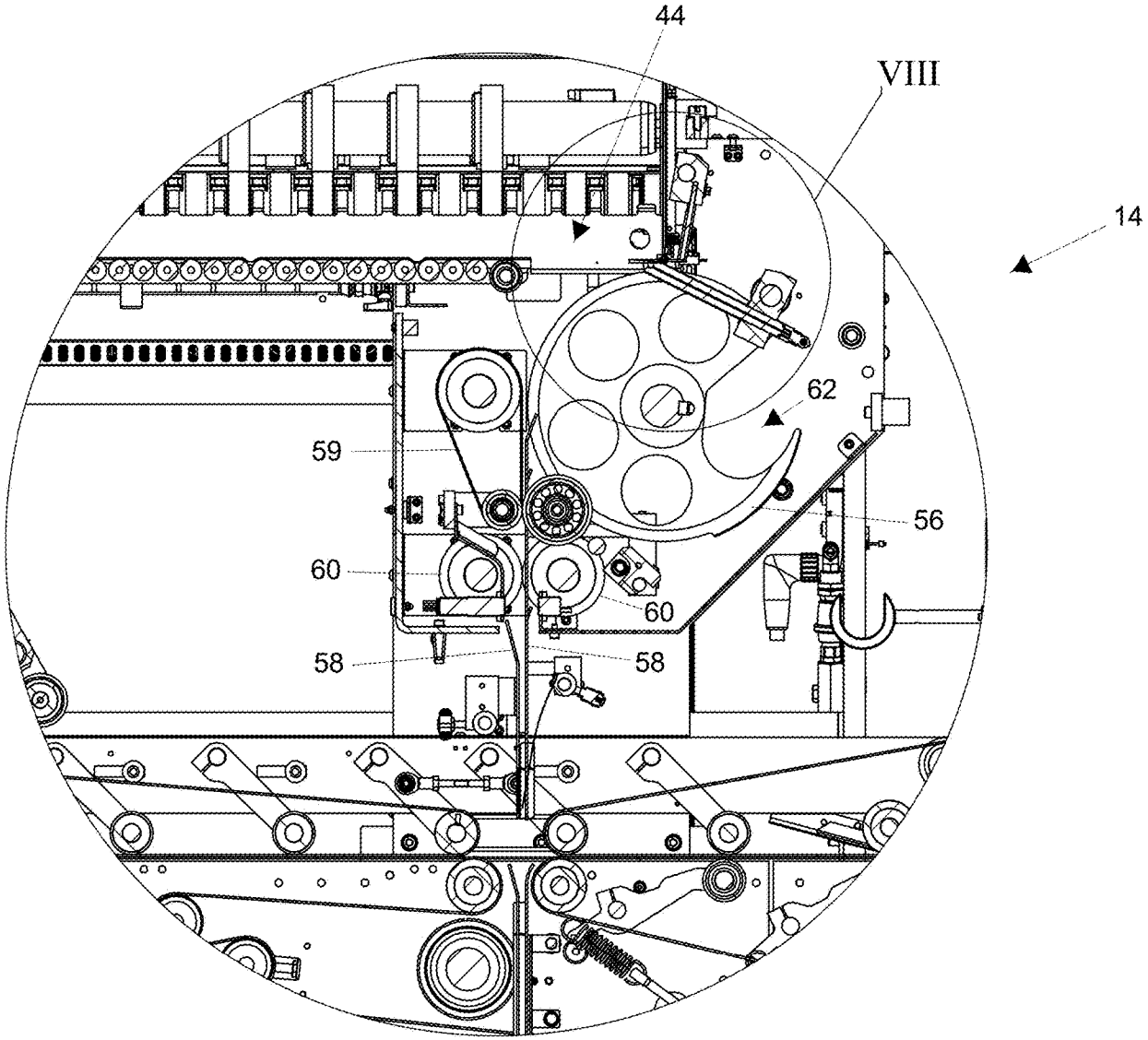
FIG. 6 is detail VI from FIG. 3.
Figure 8:
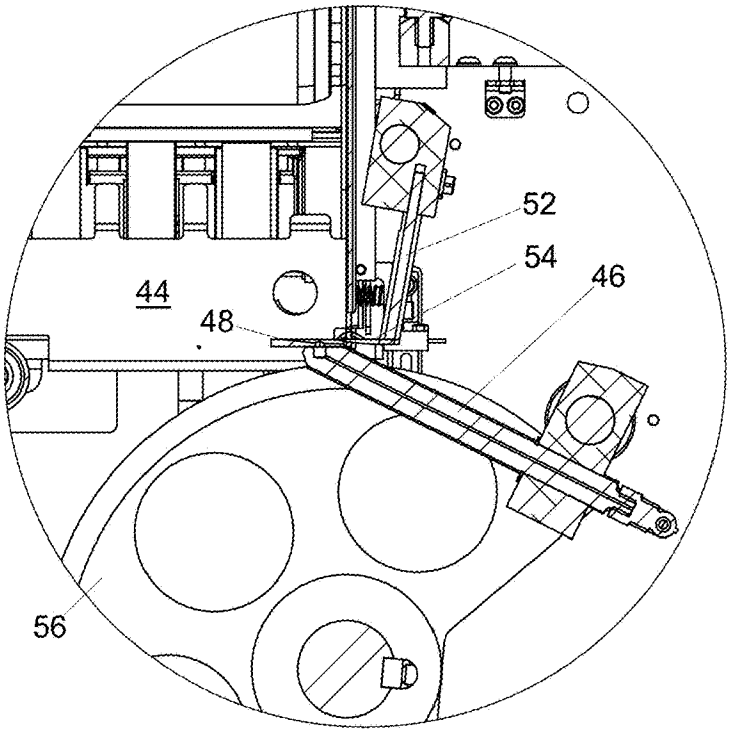
FIG. 8 is detail VIII from FIG. 6.
Figure 7:
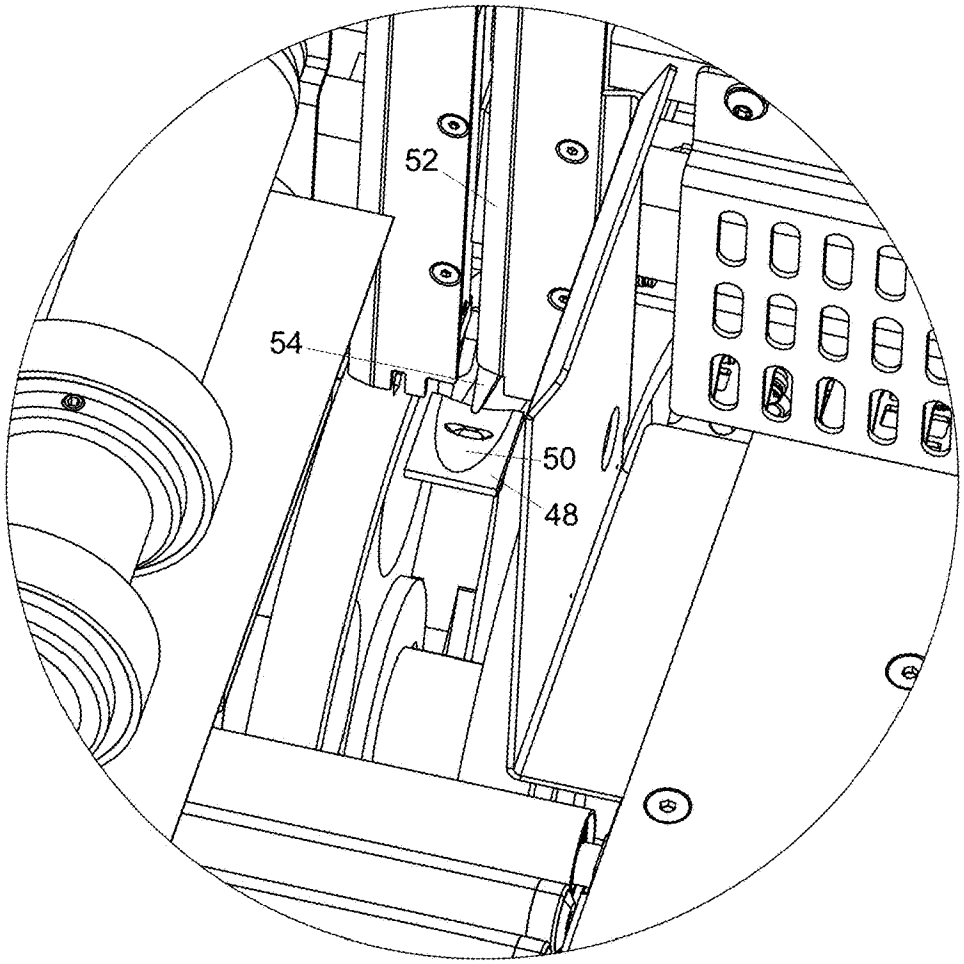
FIG. 7 is detail VII from FIG. 1.
Figure 9:
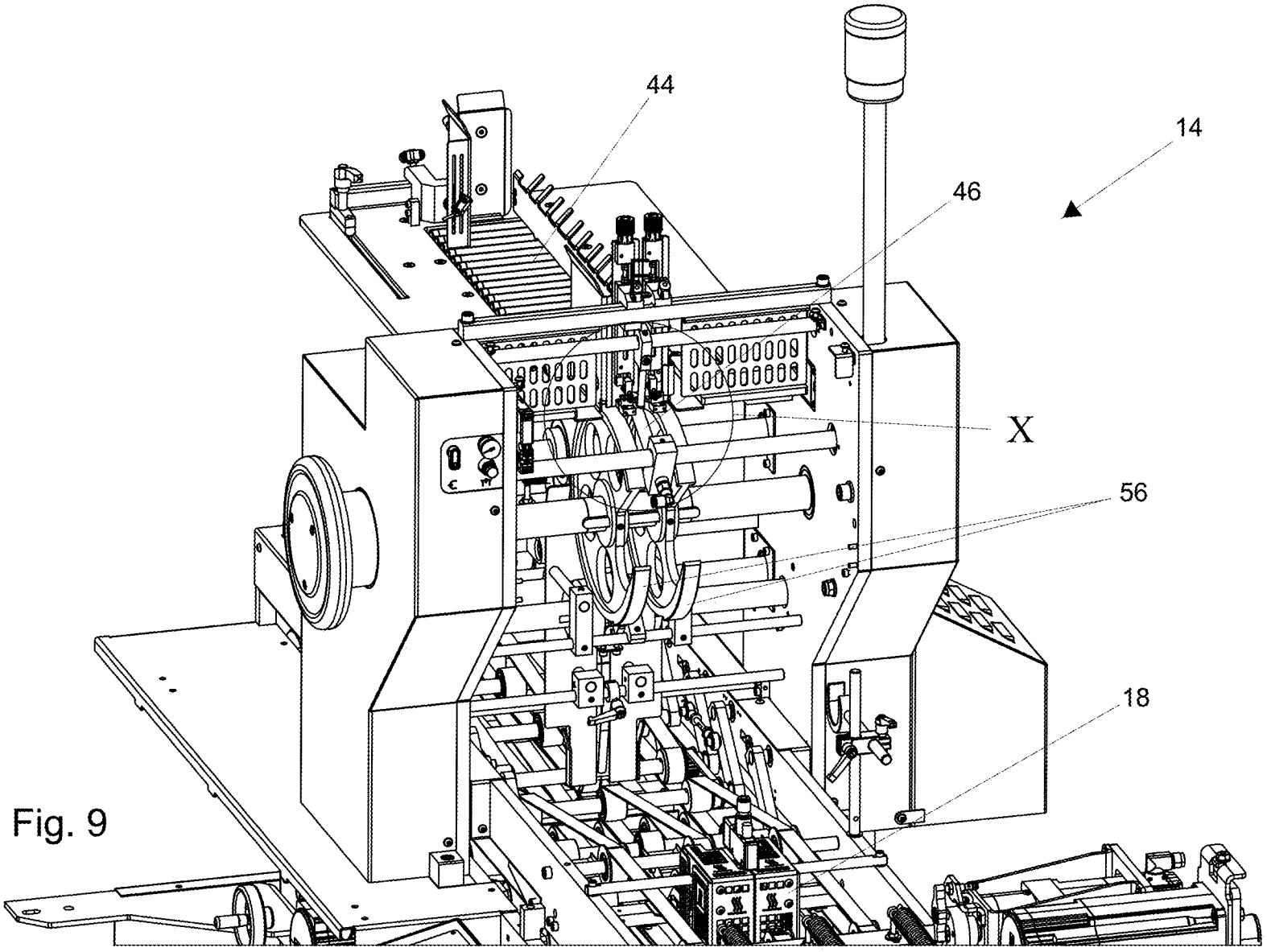
FIG. 9 is a perspective view viewed from a downstream viewpoint in an upstream direction.

Thus, a simple and quick method for producing sheets W of packaging material is provided. The web transport direction may be perpendicular to the transport direction of the mail items M of which an example is shown in FIGS. 1 and 2. A reel 38 having the size as depicted in the FIGS. 1 and 2 may suffice for producing, for example, one day or a few days without the necessity of replacing the reel 38 with a new one. This is highly beneficial for the use of production time.

In the embodiment of the wrapping module 10 having the sheet supplying station 14 as described above, an embodiment of the method may, for supplying the sheet W, comprise:

- pivoting the second pivotable arm 52 from a start position to a retracted position so that a lowest sheet W of the stack of sheets W is supported at a lower edge of the stack exclusively by the suction head 48;
- activating the suction head 48 so that the lowest sheet W is locally sucked downwardly against the concave upper surface 50 of the suction head 48 thereby creating a space between the lowest sheet W and the sheet W which is directly above the lowest sheet W in the stack;
- pivoting the second pivotable arm 52 to the start position so that the stack supporting member 54 extends in said space which has been created and supports the remaining stack of sheets W;
- pivoting the first pivotable arm 46 from a support position to a downward position in which an edge of the lowest sheet W which is held by the suction head 48 is moved into the cut-out 62 in the transport wheel 56;
- rotating the transport wheel 56 so that the sheet W is engaged between the transport wheel 56 and the pressure roller or pressure belt 59 so as to be moved along the guides 58 in the second plane for further transport towards said intermediate position.

As explained with reference to the embodiment of the wrapping module having the specific sheet supplying station 14, the method provides for a secure and reliable withdrawal of a sheet W from the sheet magazine 44.

When the sheet supplying station 14 is of the above described embodiment which comprises at least one of a transport roller and a transport belt 60, the method may, in a further elaboration of the previous embodiment comprise:

- engaging with the at least one of the transport roller and the transport belt 60 the sheet W which moves downwardly along the guides 58 so as to accelerate the sheet W; and
- continuing transporting the sheet W with at least one of the transport roller and the transport belt 60 along the guides 58 to move the sheet W through a gap between two subsequent mail items M to the intermediate position.

Thus, a spacing of the sheets W as well as very reliable positioning of the wrap W in the intermediate position may be achieved. To that end, the at least one of the transport roller and the transport belt 60 may be driven by a servo drive which is connected to an electronic controller.

The invention is not limited to the examples shown and variations and other examples are possible. At least one of the first, the second and third transport sections 12, 16, 22 shown in the examples are formed by first, second and third transport belt sections. It should however be understood that instead of transport belt sections other types of transport sections known to the skilled person are feasible. For example, a transport track surface with pushing cams is a feasible alternative solution.

In the example shown in the figures, the transport belt section each comprise a number of parallel belts. It may be beneficial when the inner belts of the second belt section 16 are drive a little slower than the outer belts of the second belt section 16. This may be easily accomplished by driving the inner belts with drive pullies which has a slightly smaller diameter than the drive pullies of the outer belts of the second belt section. Thus, the inner belts engaging the sheet W which is partly folded around the mail item M will be pulled around the leading edge of the mail item M and be tightened.

Upstream of the wrapping module 10 there may be an assembly for composing the mail item M out of a number of separate magazines and/or documents. To that end, a number of feeders may be placed along a transport track, whereby each feeder may supply a magazine or a document to a stack which is moved in the transport direction over the transport track. A downstream end of the transport track is adjacent an upstream end of the first transport section 12 of the present invention. Thus, the finalized stack composed of magazines and/or documents is the mail item which is supplied to the wrapping module 10 according to the present invention.

| LIST OF ELEMENTS | |
|---|---|
| 10. | wrapping module |
| 12. | First transport section |
| 14. | wrap supplying station |
| 16. | Second transport section |
| 18. | Glue dispensing station |
| 20. | Turning station |
| 22. | Third transport section |
| 24. | First roller |
| 26. | Leading edge lifting unit |
| 27. | Second roller |
| 28. | Pendulum |
| 30. | Pendulum foot |
| 32. | Fork assembly |
| 34. | Suction block |
| 36. | Suction openings |
| 38. | Reel |
| 40. | Cutting station |
| 42. | Fork prongs |
| 44. | wrap magazine |
| 46. | First pivotable arm |
| 48. | Suction head |
| 50. | Concave upper surface |
| 52. | Second pivotable arm |
| 54. | Stack supporting member |
| 56. | Transport wheel |
| 58. | Guides |
| 60. | Transport roller and/or transport belt |
| 62. | Cut-out in transport wheel |
| 64. | Pendulum servo drive motor |
| 66. | Fork assembly servo drive motor |
| M. | Mail item |
| W. | wrap |
| P1. | First pivot direction |
| P2. | Second pivot direction |
| S1. | First pivot axis |
| S2. | Second pivot axis |

The invention claimed is:

1. A wrapping module for providing a sleeve of packaging material around a mail item, the mail item comprising at least one printed document, wherein the wrapping module comprises:

a first transport section extending in a transport direction along a transport plane and configured for continuously transporting the mail item in the transport direction along the transport plane, the mail item having an initial leading edge and an initial trailing edge;

a sheet supplying station configured for supplying a sheet of packaging material to an intermediate position at a downstream end of the first transport section, wherein in the intermediate position the sheet extends in a second plane substantially perpendicular to the transport plane and protrudes with a first part above the transport plane and protrudes with a second part below the transport plane and in which the leading edge of the mail item is upstream from the sheet;

a second transport section extending in the transport direction along the transport plane and configured for continuously transporting the mail item in the transport direction along the transport plane, the second transport section having an upstream end adjacent the downstream end of the first transport section leaving a gap in between through which the sheet is able to pass the transport plane to the intermediate position, wherein the wrapping module is configured such that, when the mail item is transferred from the first transport section to the second transport section, the sheet in the intermediate position is engaged by the initial leading edge and subsequently the sheet is folded around the initial leading edge so that the first part is folded against an upper side of the mail item and the second part is folded against a lower side of the mail item, wherein a third part of the sheet is a part of the second part of the sheet that extends in the upstream direction beyond the initial trailing edge of the mail item;

a glue dispensing station positioned above the second transport section and configured for dispensing glue;

a turning station positioned at a downstream end of the second transport section and being configured to turn the mail item around so that the initial leading edge becomes a subsequent trailing edge and the initial trailing edge becomes a subsequent leading edge, and wherein during the turning the third part of the sheet is folded around the initial trailing edge which becomes the subsequent leading edge so that the third part of the sheet is folded against the mail item at the side along which the first part of the sheet extends as well and wherein the third part overlaps the first part and the dispensed glue provides a connection between the first part and the third part so as to form the sleeve of packaging material; and a third transport section having an upstream end adjacent to an outlet of the turning station being configured to transport the mail item being wrapped in the sleeve of packaging material further, wherein the turning station comprises:

a first roller positioned above the downstream end of the second transport section;

a leading edge lifting unit downstream of the downstream end of the second transport section and being configured to lift the initial leading edge of the mail item during transport of the initial leading edge over the leading edge lifting unit;

a pendulum pivotally mounted along a first pivot axis which extend substantially perpendicular to the transport direction and parallel to the transport plane, wherein the pendulum has a pendulum foot; and a second roller positioned downstream of the leading edge lifting unit and being positioned so as to press the mail item between the pendulum foot and the second roller, wherein the leading edge lifting unit and the second roller are mounted so as to be pivotable below the transport plane;

wherein the turning station is configured to:

lift the initial leading edge of the mail item above the transport plane during transport of the initial leading edge of the mail item over the leading edge lifting unit, subsequently engage the mail item by the pendulum foot of the pendulum at a bottom side of the mail item adjacent the initial leading edge, while pivoting the pendulum in a first pivot direction, continue to pivot the pendulum in the first pivot direction while pressing the mail item against the first roller until the initial trailing edge of the mail item is raised to a level equal or higher than an upper side of the circumference of the second roller, and subsequently reverse pivot direction of the pendulum and move the pendulum in a second pivot direction opposite the first pivot direction, so that the initial trailing edge of the mail item becomes the subsequent leading edge and is moved over the second roller, and wherein the mail item is subsequently pressed onto the second roller by the pendulum foot and is transferred to the third transport section.

2. The wrapping module according to claim 1, wherein the turning station comprises:

a fork assembly pivotally mounted along a second pivot axis extending substantially perpendicular to the transport direction and parallel to the transport plane, wherein the fork assembly has a number of fork prongs, wherein the first roller has a number of slits through which the fork prongs extend;

wherein the fork assembly is configured to pivot downwardly at the moment that the pendulum movement reverses from the first pivot direction to the second pivot direction so that the initial trailing edge of the mail item is pushed in the transport direction by the fork prongs so as to be transportable over the second roller.

3. The wrapping module according to claim 1, wherein the wrapping module comprises a suction block mounted directly upstream of the turning station, wherein the suction block has upwardly directed suction openings positioned directly below the transport plane, wherein the wrapping module is configured to activate the suction block at least during passage of the third part of the sheet over the suction block at which time the initial leading edge of the mail item as well as the first and the second part of the sheet are pressed between the pendulum foot and the first roller thereby effecting that the third part of the sheet is pulled at by air sucked into the suction openings resulting in a tightening of the sheet along the initial leading edge and the upper and the lower side of the mail item.

4. The wrapping module according to claim 1, comprising:

a reel including a web of packaging material;

a cutting station to cut separate sheets of packaging material from the web of packaging material; and a sheet magazine in which the sheets cut from the web are stacked on top of each other.

5. The wrapping module according to claim 4, wherein the cutting station comprises a cutting knife movable with a cutting frequency the cutting frequency being adjustable so as to adjust a width of the sheet of packaging material that is produced by the cutting station.

6. The wrapping module according to claim 1, wherein the position of the first pivot axis of the pendulum is adjustable.

7. The wrapping module according to claim 6, comprising a third drive configured to adjust the position of the first pivot axis of the pendulum.

8. The wrapping module according to claim 1, wherein a packaging module for packaging mail items is provided downstream of the wrapping module.

9. A wrapping module for providing a sleeve of packaging material around a mail item, the mail item comprising at least one printed document, wherein the wrapping module comprises:

a first transport section extending in a transport direction along a transport plane and configured for continuously transporting the mail item in the transport direction along the transport plane, the mail item having an initial leading edge and an initial trailing edge;

a sheet supplying station configured for supplying a sheet of packaging material to an intermediate position at a downstream end of the first transport section, wherein in the intermediate position the sheet extends in a second plane substantially perpendicular to the transport plane and protrudes with a first part above the transport plane and protrudes with a second part below the transport plane and in which the leading edge of the mail item is upstream from the sheet;

a second transport section extending in the transport direction along the transport plane and configured for continuously transporting the mail item in the transport direction along the transport plane, the second transport section having an upstream end adjacent the downstream end of the first transport section leaving a gap in between through which the sheet is able to pass the transport plane to the intermediate position, wherein the wrapping module is configured such that, when the mail item is transferred from the first transport section to the second transport section, the sheet in the intermediate position is engaged by the initial leading edge and subsequently the sheet is folded around the initial leading edge so that the first part is folded against an upper side of the mail item and the second part is folded against a lower side of the mail item, wherein a third part of the sheet is a part of the second part of the sheet that extends in the upstream direction beyond the initial trailing edge of the mail item;

a glue dispensing station positioned above the second transport section and configured for dispensing glue;

a turning station positioned at a downstream end of the second transport section and being configured to turn the mail item around so that the initial leading edge becomes a subsequent trailing edge and the initial trailing edge becomes a subsequent leading edge, and wherein during the turning the third part of the sheet is folded around the initial trailing edge which becomes the subsequent leading edge so that the third part of the sheet is folded against the mail item at the side along which the first part of the sheet extends as well and wherein the third part overlaps the first part and the dispensed glue provides a connection between the first part and the third part so as to form the sleeve of packaging material; and a third transport section having an upstream end adjacent to an outlet of the turning station being configured to transport the mail item being wrapped in the sleeve of packaging material further, a sheet supplying station comprising:

a sheet magazine for storing a stack of sheets of packaging material;

a first pivotable arm at the end of which a suction head is provided having a concave upper surface;

a second pivotable arm at the end of which a stack supporting member is provided;

a transport wheel having a cut-out along the circumference;

a pressure roller or pressure belt positioned opposite the transport wheel; and guides for guiding the sheet along the second plane, wherein for supplying the sheet the sheet supplying station is configured to:

pivot the second pivotable arm from a start position to a retracted position so that a lowest sheet of the stack of sheets is supported at one lower edge of the stack exclusively by the suction head;

activate the suction head so that the lowest sheet is locally sucked downwardly against the concave upper surface of the suction head thereby creating a space between the lowest sheet and a sheet directly above the lowest sheet in the stack;

pivot the second pivotable arm to the start position so that the stack supporting member extends in said space which has been created and supports the remaining stack of sheets;

pivot the first pivotable arm from a support position to a downward position in which an edge of the lowest sheet held by the suction head is moved into the cut-out in the transport wheel; and rotate the transport wheel so that the sheet is engaged between the transport wheel and the pressure roller or pressure belt so as to be moved along the guides in the second plane for further transport towards said intermediate position.

10. The wrapping module according to claim 9, wherein the sheet supplying station comprises a transport roller or transport belt configured to accelerate the sheet so as to transport the sheet along the guides and move the sheet through a gap between two subsequent mail items to the intermediate position.

11. The wrapping module according to claim 9, wherein the turning station comprises:

a first roller positioned above the downstream end of the second transport section;

a leading edge lifting unit downstream of the downstream end of the second transport section and being configured to lift the initial leading edge of the mail item during transport of the initial leading edge over the leading edge lifting unit;

a pendulum pivotally mounted along a first pivot axis which extend substantially perpendicular to the transport direction and parallel to the transport plane, wherein the pendulum has a pendulum foot;

a second roller positioned downstream of the leading edge lifting unit and being positioned so as to press the mail item between the pendulum foot and the second roller;

wherein the turning station is configured to:

lift the initial leading edge of the mail item above the transport plane during transport of the initial leading edge of the mail item over the leading edge lifting unit, subsequently engage the mail item by the pendulum foot of the pendulum at a bottom side of the mail item adjacent the initial leading edge, while pivoting the pendulum in a first pivot direction, continue to pivot the pendulum in the first pivot direction while pressing the mail item against the first roller until the initial trailing edge of the mail item is raised to a level equal or higher than an upper side of the circumference of the second roller, and subsequently reverse pivot direction of the pendulum and move the pendulum in a second pivot direction opposite the first pivot direction, so that the initial trailing edge of the mail item becomes the subsequent leading edge and is moved over the second roller and wherein the mail item is subsequently pressed onto the second roller by the pendulum foot and is transferred to the third transport section.

12. The wrapping module according to claim 11, wherein the turning station comprises:

a fork assembly pivotally mounted along a second pivot axis extending substantially perpendicular to the transport direction and parallel to the transport plane, wherein the fork assembly has a number of fork prongs, wherein the first roller has a number of slits through which the fork prongs extend;

wherein the fork assembly is configured to pivot downwardly at the moment that the pendulum movement reverses from the first pivot direction to the second pivot direction so that the initial trailing edge of the mail item is pushed in the transport direction by the fork prongs so as to be transportable over the second roller.

13. The wrapping module according to claim 11, wherein the position of the first pivot axis of the pendulum is adjustable.

14. The wrapping module according to claim 13, comprising a third drive configured to adjust the position of the first pivot axis of the pendulum.

15. The wrapping module according to claim 11, wherein the leading edge lifting unit and the second roller are mounted so as to be pivotable below the transport plane, and wherein a packaging module for packaging mail items is provided downstream of the wrapping module.

16. The wrapping module according to claim 9, wherein the wrapping module comprises a suction block mounted directly upstream of the turning station, wherein the suction block has upwardly directed suction openings positioned directly below the transport plane, wherein the wrapping module is configured to activate the suction block at least during passage of the third part of the sheet over the suction block at which time the initial leading edge of the mail item as well as the first and the second part of the sheet are pressed between the pendulum foot and the first roller thereby effecting that the third part of the sheet is pulled at by air sucked into the suction openings resulting in a tightening of the sheet along the initial leading edge and the upper and the lower side of the mail item.

17. The wrapping module according to claim 9, comprising:

a reel including a web of packaging material;

a cutting station to cut separate sheets of packaging material from the web of packaging material; and wherein the sheets cut from the web are stacked on top of each other in the sheet magazine.

18. The wrapping module according to claim 17, wherein the cutting station comprises a cutting knife movable with a cutting frequency, the cutting frequency being adjustable so as to adjust a width of the sheet of packaging material that is produced by the cutting station.

* * * * *